US006246298B1

(12) United States Patent
Ishikawa et al.

(10) Patent No.: US 6,246,298 B1
(45) Date of Patent: Jun. 12, 2001

(54) DIELECTRIC LINE SWITCH AND ANTENNA DEVICE

(75) Inventors: Yohei Ishikawa, Kyoto; Koichi Sakamoto, Otsu; Toru Tanizaki, Kyoto; Hiroshi Nishida, Kawanishi; Taiyo Nishiyama, Otsu; Nobuhiro Kondo, Hirakata; Atsushi Saitoh, Muko; Yoshinori Taguchi, Kyoto-fu; Hideaki Yamada, Ishikawa-ken, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/176,362

(22) Filed: Oct. 21, 1998

(30) Foreign Application Priority Data

Oct. 23, 1997 (JP) ..... 9-291208

(51) Int. Cl.[7] ..... H01P 1/10
(52) U.S. Cl. ..... 333/101; 333/106; 333/258
(58) Field of Search ..... 333/106, 108, 333/258, 259, 239, 248, 113; 455/326

(56) References Cited

U.S. PATENT DOCUMENTS 2,832,933 * 6/1958 Greenslit et al. ..... 333/106
4,692,721 9/1987 Ito et al. .
4,831,222 5/1989 Grellmann et al. .
5,724,013 * 3/1998 Ishikawa et al. ..... 333/254

FOREIGN PATENT DOCUMENTS 331382 7/1958 (DE) .
0700112 3/1996 (EP) .

OTHER PUBLICATIONS

Tanizaki et al. "Multi–Beam Automotive Radar Front end Using Non–Contact Cylindrical NRD Switch", Baltimore, MD Jun. 7–12, 1998, New York pp. 521–524.

* cited by examiner

*Primary Examiner*—Robert Pascal
*Assistant Examiner*—Kimberly E Glenn
(74) *Attorney, Agent, or Firm*—Ostrolenk, Faber, Gerb & Soffen, LLP

(57) ABSTRACT

A dielectric line switch is provided which is capable of easily controlling the propagation of an electromagnetic wave. Also provided is an antenna device employing said dielectric line switch. As an embodiment of the invention, a plurality of dielectric lines and a plurality of primary radiators are provided on a rotary unit. With the rotation of the rotary unit, the dielectric lines are switched ON and OFF by virtue of mechanical means, so that a desired change-over may be effected among the plurality of primary radiators in a time sharing manner, and the positions of the primary radiators may be shifted within a plane of the focal point of a dielectric lens, thereby enabling the transmission wave beam and/or reception wave beam to scan in a desired manner.

6 Claims, 30 Drawing Sheets

ON STATE

OFF STATE

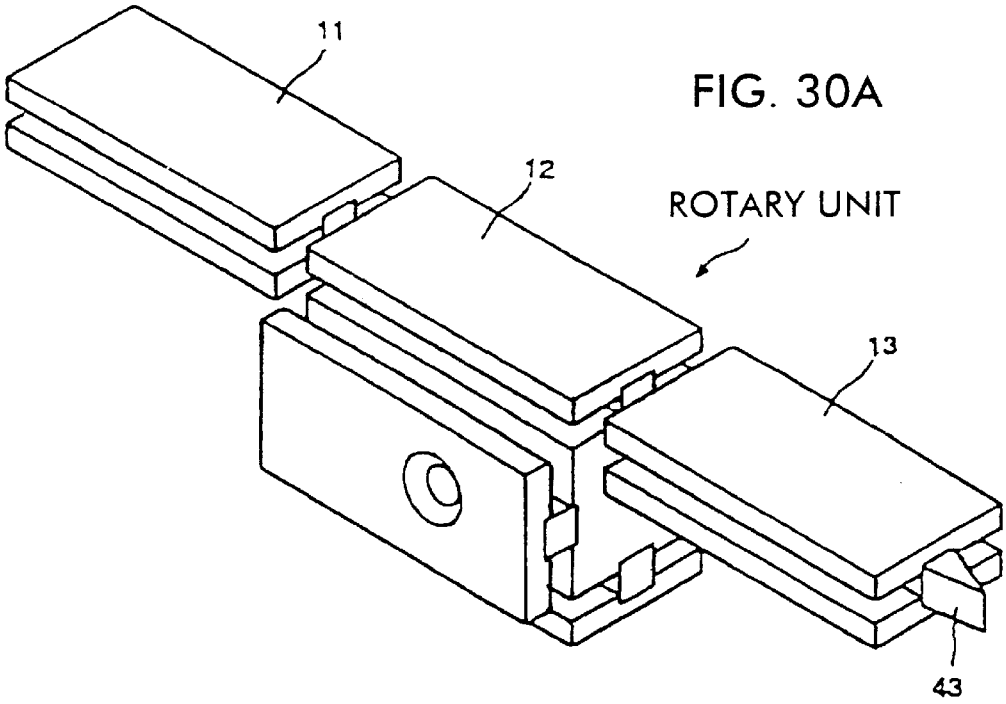
FIG. 30A
FIG. 30B
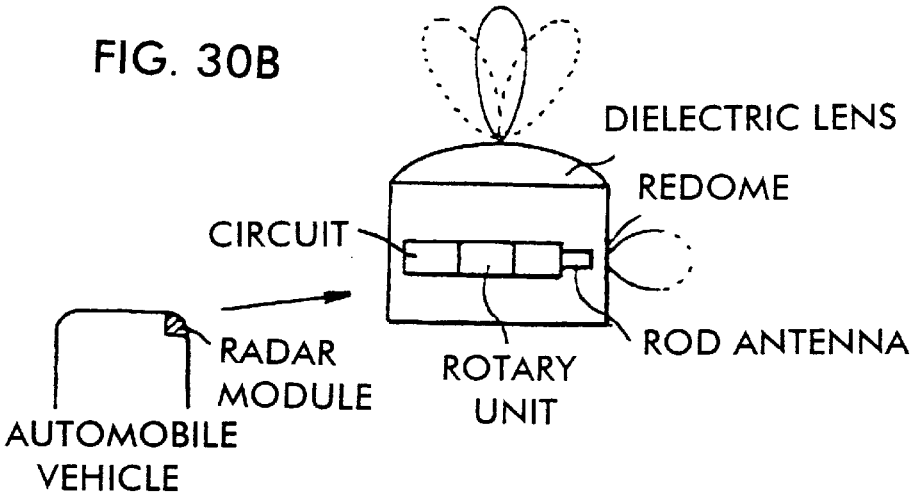
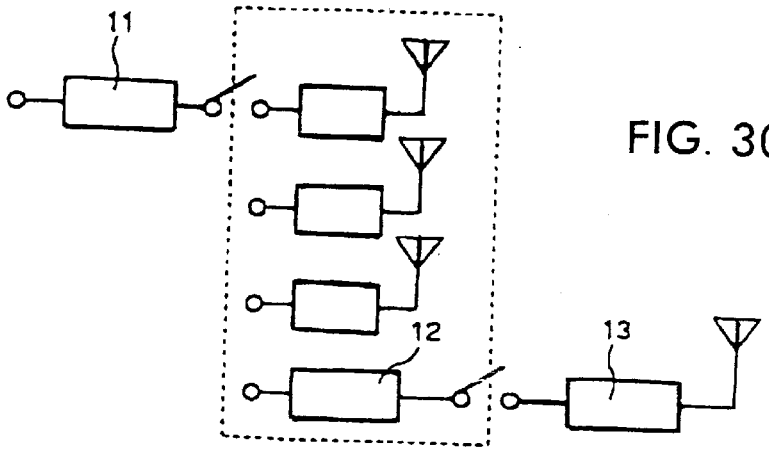
FIG. 30C

POSITION OF PRIMARY RADIATOR

FIG. 32A
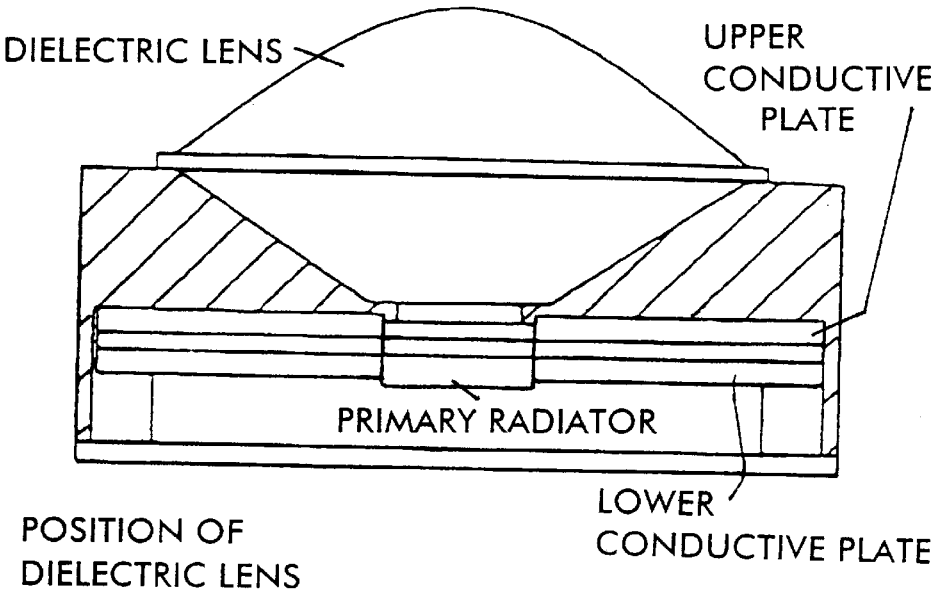
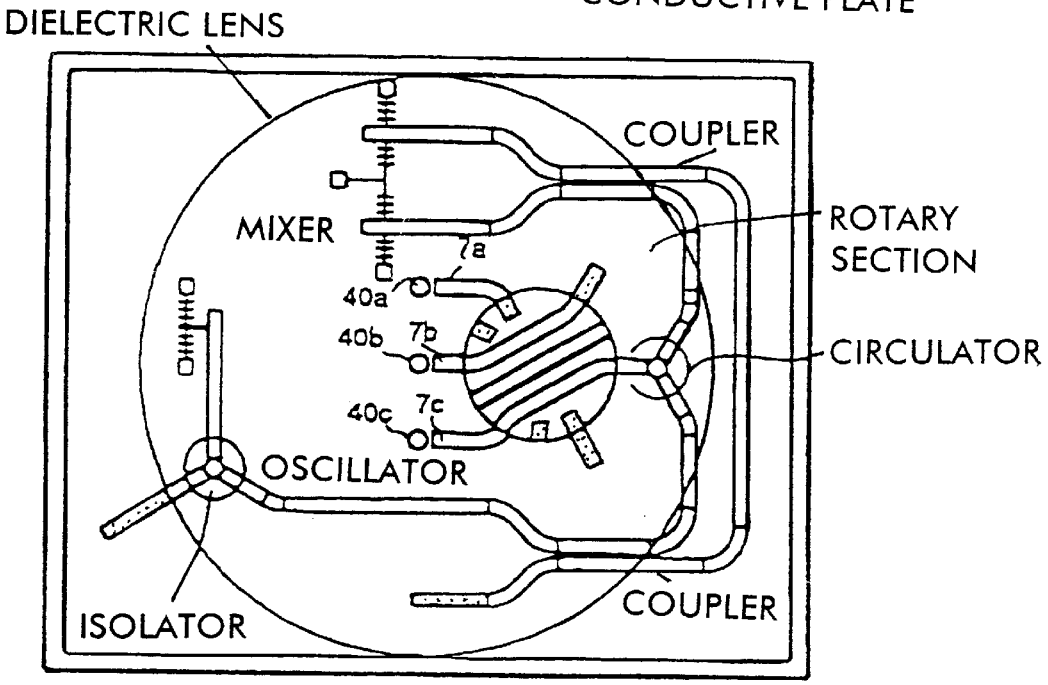
FIG. 32B
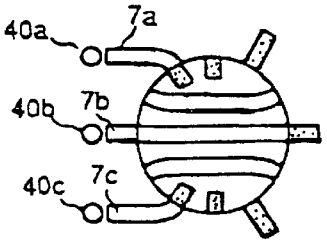
FIG. 32C

DIELECTRIC LINE SWITCH AND ANTENNA DEVICE

BACKGROUND OF THE INVENTION

1. Field of the Invention

The present invention relates to a switch for use in a dielectric line provided for the propagation of an electromagnetic wave such as a millimeter wave, the present invention also relates to an antenna device employing the dielectric line.

2. Description of the Related Art

Conventionally, with a vehicle radar module and a radio communication module, there had been suggested a circuit which is in the form of non-radial dielectric line (hereinafter, referred to as NRD GUIDE). In practice, such NRD GUIDE may be obtained in the following way. Namely, some units such as directional coupler or isolator may be easily fabricated by bringing dielectric lines into mutually adjacent positions and by adding some additional substances such as ferrite, then, a planar circuit board is inserted into a central position of the dielectric lines so as to attach semiconductor elements and some other functional elements in positions, thereby forming the NRD GUIDE.

FIG. 38A is a partially sectional side elevation illustrating the structure of a millimeter wave radar module using the NRD GUIDE. FIG. 38B is a plane view illustrating the radar module of FIG. 38A. In fact, the radar module is equipped with the NRD GUIDE which is for use as a propagation path for a millimeter wave to pass therethrough. Here, the NRD GUIDE itself includes an upper conductive plate, a lower conductive plate, linear or curved rod-like dielectric strips interposed between the upper and lower conductive plates. In more detail, as shown in FIG. 38B, the radar module further includes an oscillator (millimeter wave oscillator), an isolator, a coupler (directional coupler), a circulator, a mixer, a primary radiator for signal transmission and signal reception. Further, a dielectric lens is installed above the primary radiator by a predetermined distance.

If the radar module shown in FIGS. 38A and 38B is used as FM-CW radar which employs a transmission signal (which has been treated in frequency modulation so as to become a CW (Continuous Wave), a millimeter wave signal generated in the oscillator and treated in FM modulation, is first passed through the isolator and then through the coupler. Afterwards, one half of the signal is supplied to the circulator, while the other half of the signal is used as a local signal to be supplied to the mixer. The signal supplied to the circulator is transmitted to a dielectric resonator of the primary radiator, passing through an electromagnetic wave radiating window so as to be radiated from the dielectric lens. Then, a reflected wave from an object is incident on to the dielectric lens, received by the primary radiator (including an electromagnetic wave radiating window and a dielectric resonator), and further passed through the circulator so as to be supplied as a RF (Radio Frequency) signal to the mixer. In the mixer, the RF signal and the local signal are mixed together, to produce an output signal as an IF (Intermediate Frequency) signal containing a distance information and a speed difference information.

In the past, a monitoring radar module (mounted on a vehicle for monitoring a forward situation) is provided with a beam antenna having a highly sensitive directivity so that it has a high gain and can prevent any possible interference from a vehicle travelling along an adjacent line. However, when a vehicle is travelling along a curved line, there will be a detection mistake as if a vehicle running along an adjacent line is travelling ahead of itself. In order to solve this problem, not only is it necessary to obtain a distance information indicating a distance between itself (this vehicle) and an ahead running vehicle, but also it is necessary to obtain an azimuth information indicating the azimuth of a vehicle travelling along an adjacent line.

Conventionally, there have been two methods which can be used to obtain an azimuth information. One method employs a scanning type radar capable of rendering an electromagnetic wave beam to scan within an appropriate angle. The other method employs a mono-pulse type radar which functions with the use of a sum signal obtained by adding together signals from two or more antennas of different radiating patterns, and also with the use of a deference signal obtained by performing a deducting calculation among the signals from the two or more antennas of different radiating patterns.

With the above scanning type radar, it is allowed to mechanically rotate the radar module by a motor to enable the radar beam to scan within a range of a sector (a fan shape), but it is difficult to perform a high speed scanning, and the apparatus as a whole is too large and bulky. Although it is possible to provide an electronic switch within the circuit to perform a desired change-over among a plurality of antennas, it is still needed to use many antennas and a highly functional NRD GUIDE switch. As a result, it is difficult to manufacture the scanning type radar with a compact size and a low cost. Further, if using a different manner where a beam is caused to perform a desired scanning but without moving the antennas, it is possible to perform a phase scanning capable of changing a directing angle into any direction by arranging the antennas in a predetermined array and by controlling the phase of a feeding signal (which is to be fed to the antennas). However, there still exists a problem that it is difficult to manufacture the scanning type radar with a compact size and a low cost.

On the other hand, with the above mono-pulse type radar, the apparatus is allowed to be made compact in size. However, since it is needed to cover an azimuth range (which is to be detected), it is necessary to use antennas each having a large beam width. For this reason, the gain of the radar is correspondingly reduced. To solve this problem, it is required to either increase an output power of the radar in order to effect a needed detection on a position located far away, or to provide active functional element for use as an amplifier in a signal receiving circuit so as to improve its signal receiving sensitivity. However, at present time it has been proved difficult to obtain a desired effect from the provision of the active functional element if a signal is in the form of a millimeter wave.

SUMMARY OF THE INVENTION

In view of the above discussed problems associated with the above-mentioned prior art, it is an object of the present invention to provide an improved antenna device employing dielectric lines, which is compact in size and may be manufactured with a low cost.

It is another object of the present invention to provide a dielectric line switch capable of easily controlling the transmission of an electromagnetic wave, said switch being suitable for use in a dielectric line device such as an antenna device employing a dielectric line.

In order to achieve the above objects of the present invention, there is provided a dielectric line switch for use in a dielectric line, said dielectric line including two conductive plates arranged in a manner such that they are substantially parallel to each other, and a dielectric strip interposed between the two conductive plates, said dielectric strip serving as a propagation path for an electro-magnetic wave to propagate therethrough, said dielectric line switch being characterized in that: a plane generally perpendicular to a propagating direction of an electromagnetic wave is defined as a dividing plane so as to render the dielectric line to be divided into two dielectric lines; the two dielectric lines are caused to move relatively with respect to one another at the above dividing plane, in a manner such that two dielectric strips of the two dielectric lines may be, at the same dividing plane, made facing each other and not facing each other, alternatively. In this way, a mutually facing state of the two dielectric lines may be varied at a dividing plane. When the two strips of the two dielectric lines are facing each other, an electromagnetic wave is allowed to propagate therethrough. On the other hand, when the two strips of the two dielectric lines are not facing each other, an electromagnetic wave will not be allowed to propagate therethrough, thereby effecting a stop of the propagation of the electro-magnetic wave. In fact, a mutually facing state of the two dielectric lines may be varied in a desired manner with the use of a mechanical control means, so that the above-defined structure may serve as a dielectric line switch adapted to perform a controlling action by means of mechanical change-over operation.

Further, the relative movement of the two dielectric strips at the above dividing plane is achieved by a rotating movement of at least one of the two dielectric lines. Alternatively, the relative movement of the two dielectric strips at the above dividing plane is achieved by a linear movement of at least one of the two dielectric lines.

In one aspect of the present invention, the above dielectric line switch is also characterized in that: when a direction perpendicular to the conductive plates is defined as a direction x, an electromagnetic propagating direction is defined as a direction z, a direction perpendicular to both the direction x and the direction z is defined as a direction y, there is provided a polygonal prismatic block member having at least three side faces; on the entire or part of each of the side faces there is provided one of the above dielectric lines which enables an axial direction of the polygonal prismatic block member to act as an electro-magnetic propagating direction z; a central axis of the polygonal prismatic block member is used as a rotating center so as to rotate the polygonal prismatic block member, thereby rendering the one dielectric line to move generally in a direction y. With the use of this constitution, only by rotating the polygonal prismatic block member, a plurality of other dielectric lines may be selectively made directly facing certain one dielectric line, so as to form a desired dielectric line switch which may enable a plurality of dielectric lines to be successively connected to the certain one dielectric line, with the use of a simplified structure.

In another aspect of the present invention, the above dielectric line switch is also characterized in that: when a direction perpendicular to the conductive plates is defined as a direction x, an electromagnetic propagating direction is defined as a direction z, a direction perpendicular to both the direction x and the direction z is defined as a direction y, one of the above two dielectric lines may be rotated in a direction parallel to the conductive plates, thereby enabling the one dielectric line to move substantially in a direction y. With the use of this constitution, since one of the above two dielectric lines may be rotated in a direction parallel to the conductive plates, it is possible to manufacture a dielectric line switch which has only a small thickness. Moreover, the dielectric line switch is further characterized in that: one of the above two dielectric lines may be rotated with the direction y serving as a rotating axis, thereby enabling the one dielectric line to move substantially in a direction x.

In a further aspect of the present invention, the above dielectric line switch is also characterized in that: one of the above two dielectric lines may be rotated with the direction z serving as a rotating axis, thereby enabling the one dielectric line to move substantially in a direction x.

In order to achieve the above objects of the present invention, there is also provided an antenna device comprising a plurality of dielectric lines, characterized in that each of the dielectric lines is provided with a primary radiator on an end or middle portion thereof, dielectric line switches made in the above-described manner are provided between the plurality of dielectric lines and other dielectric lines, so as to effect an input/output change-over between said other dielectric lines and said primary radiators. In this way, the plurality of primary radiators may be selectively used, thereby rendering the antenna to perform an easy operation for the change-over of electromagnetic wave beams.

In addition, in one more aspect of the present invention, a plurality of primary radiators are disposed at positions close to a focal point of a dielectric lens, a change-over operation may be performed among the primary radiators to deflect beams of transmission wave and/or reception wave. With the use of this structure, it is allowed to deflect beams of transmission wave and/or reception wave, only by virtue of a mechanical control without any necessity of moving the entire apparatus of a radar module.

BRIEF DESCRIPTION OF THE DRAWINGS

FIGS. 30A and 30B are a perspective view and an explanatory view, indicating the structure of a radar module.

FIG. 30C is a block diagram indicating an equivalent circuit for the radar module of FIGS. 30A and 30B.

FIGS. 32A–32C are explanatory views indicating the structure of a radar module.

DESCRIPTION OF THE PREFERRED EMBODIMENT

A basic structure of a dielectric line switch of the present invention will be described in detail in the following, with reference to FIGS. 1–7.

Figure 1A:
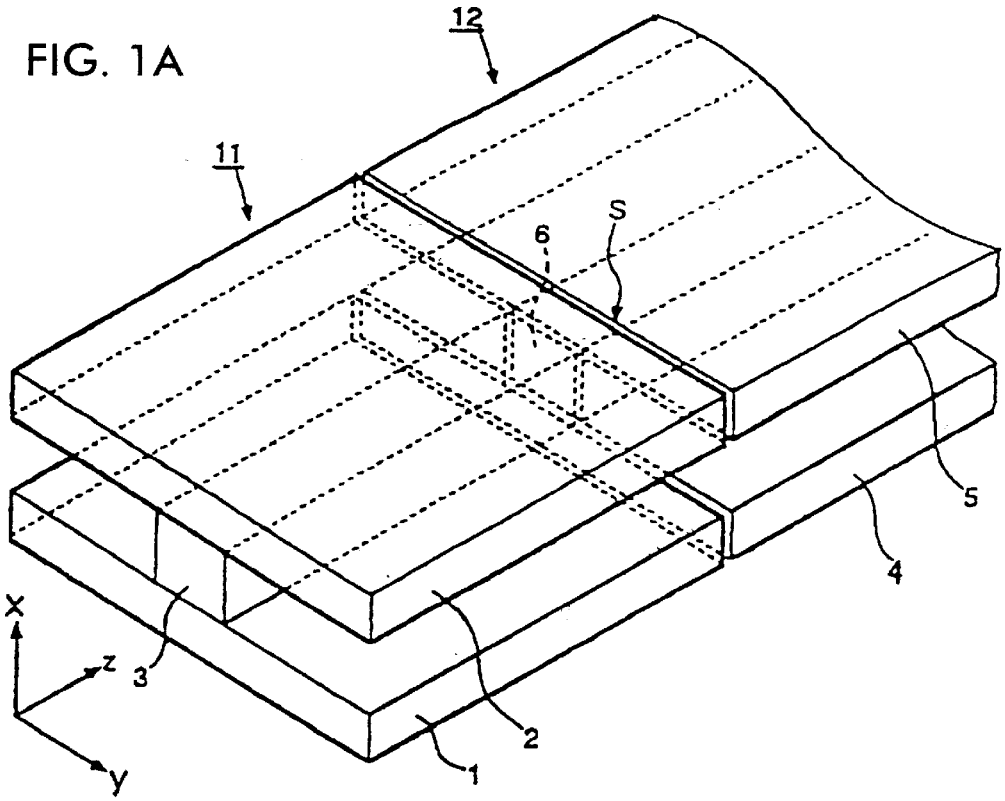
FIG. 1A is a perspective view schematically indicating the basic structure of a dielectric line switch made according to one embodiment of the present invention.
Figure 1B:
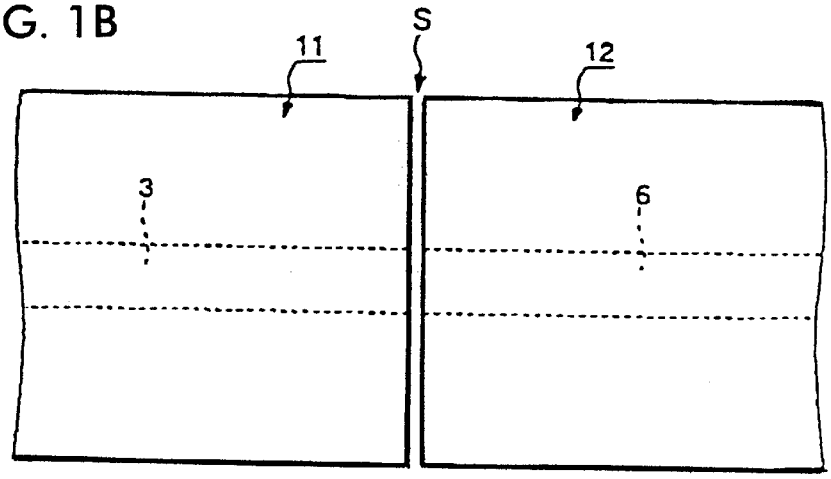
FIG. 1B is a side view indicating the dielectric line switch of FIG. 1A.
Figure 1C:
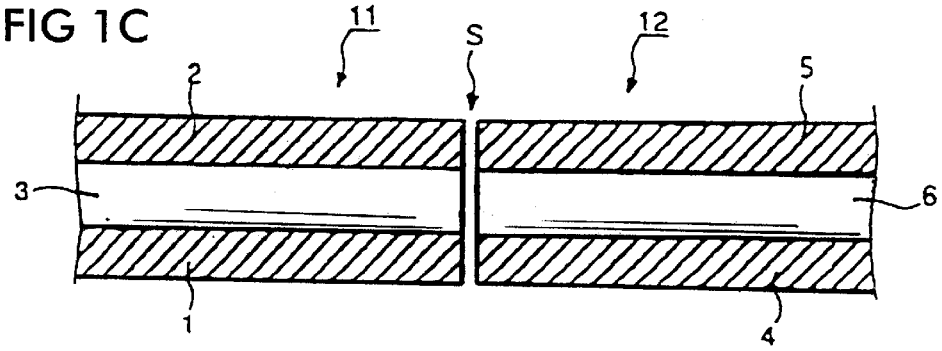
FIG. 1C is a cross sectional view indicating the dielectric line switch of FIG. 1A.

FIGS. 1A–1C are used to indicate the main structures of two dielectric lines. FIG. 1A is a perspective view, FIG. 1B is a plane view, FIG. 1C is a cross sectional view taken along dielectric strips. Referring to FIGS. 1A–1C, reference numerals 1 and 2 are used to represent two mutually parallel conductive plates forming two conductive surfaces, a reference numeral 3 is used to represent a rod-like dielectric strip disposed between the two conductive plates 1, 2. This structure thus forms a normal type dielectric line 11. Similarly, a rod-like dielectric strip 6 is interposed between two mutually parallel conductive plates 4, 5 so as to form another normal type dielectric line 12. The two dielectric lines 11 and 12 are arranged to face each other through a dividing plane S, as shown in FIGS. 1A–1C.

Here, a direction perpendicular to the conductive plates 1, 2, 4, 5 is defined as a direction x, an electro-magnetic propagating direction (i.e., a direction in which the electric strips 3 and 6 are arranged) is defined as a direction z, a direction perpendicular to both the direction x and the direction z is defined as a direction y. In this way, as shown in FIG. 2, it is allowed to perform a switching operation by moving the dielectric line 12 in any one of the directions x, y, xθ, yθ, or in any one of the directions approximately equal to the above directions.

Figure 2:
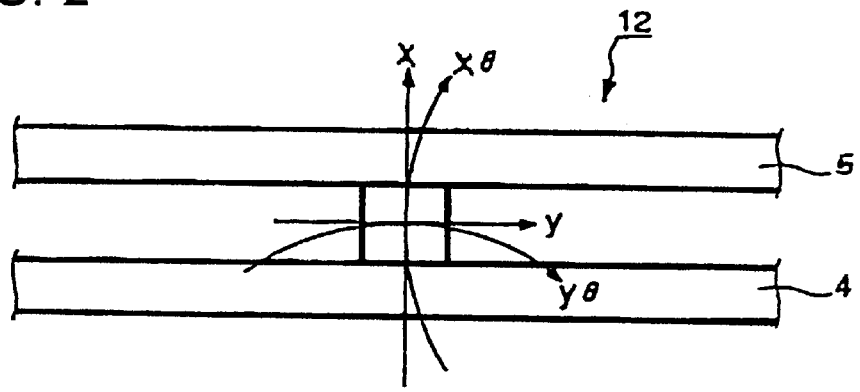
FIG. 2 is an explanatory view indicating some possible moving directions of a dielectric line.
Figure 3:
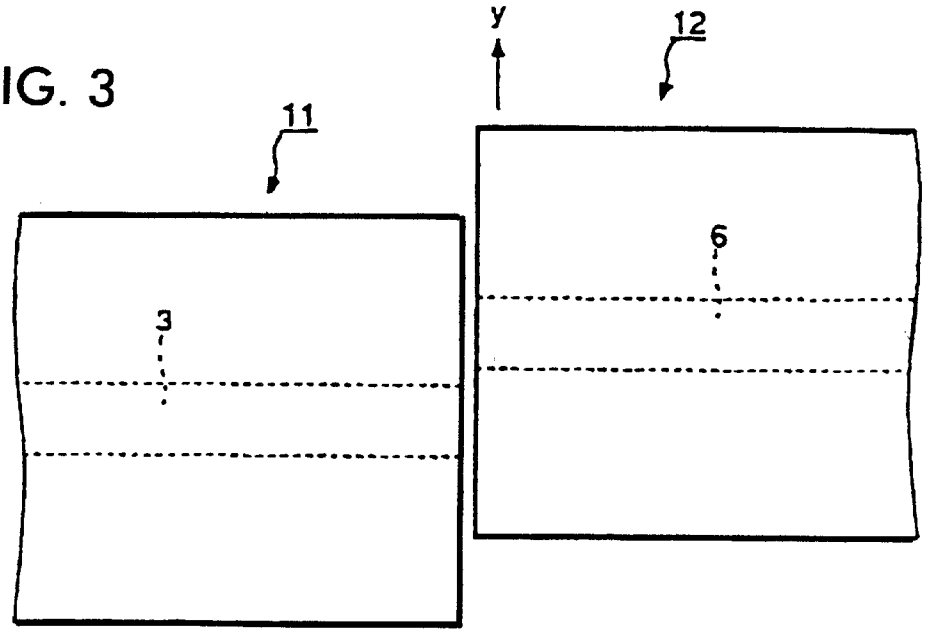
FIG. 3 is an explanatory view indicating an example in which a dielectric line is moved in a direction y.

FIG. 3 is an explanatory view illustrating a switching operation which is effected by moving the dielectric line 12 in a direction y shown in FIG. 2. As shown in FIG. 3, by shifting the dielectric line 12 in a direction y through a relative movement with respect to the dielectric line 11, the dielectric strip 3 and the dielectric strip 6 will be staggered from each other, so that they are not in their mutually facing positions.

Figure 4:
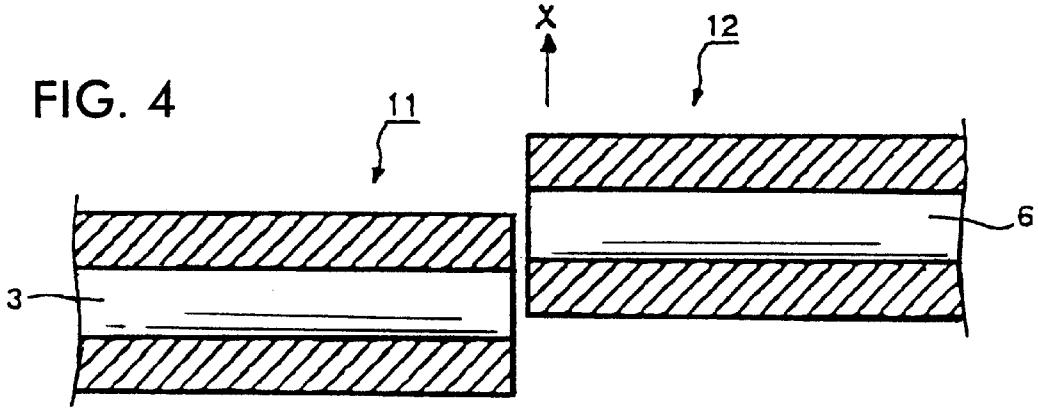
FIG. 4 is an explanatory view indicating an example in which a dielectric line is moved in a direction x.

FIG. 4 is an explanatory view illustrating a switching operation which is effected by moving the dielectric line 12 in a direction x shown in FIG. 2. As shown in FIG. 4, by shifting the dielectric line 12 in a direction x through a relative movement with respect to the dielectric line 11, the dielectric strip 3 and the dielectric strip 6 will be staggered from each other, so that they are not in their mutually facing positions.

The movement of the above dielectric line 12 may be effected either through manual operation or with the use of an actuator capable of linearly moving by virtue of electro-magnetic means.

Figure 5A:
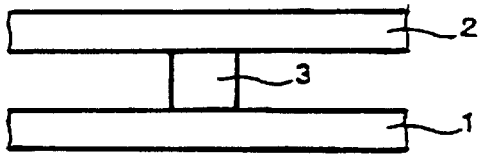
FIGS. 5A and 5B are explanatory views schematically indicating an example in which a dielectric line is moved in a direction xθ.
Figure 5B:
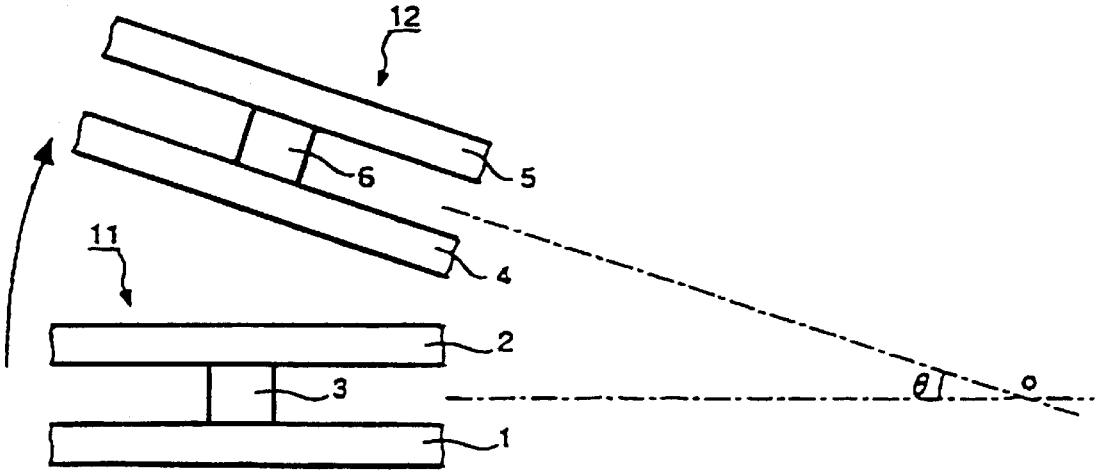

FIGS. 5A and 5B are explanatory views illustrating a switching operation which is effected by moving the dielectric line 12 in a direction xθ shown in FIG. 2. In detail, FIG. 5A indicates a condition viewed at the dielectric line 11 when the two dielectric lines 11 and 12 are positioned facing each other as shown in FIGS. 1A–1C. FIG. 5B indicates a condition where the dielectric line 12 has been rotated by an angle of θ with respect to the dielectric line 11. However, if a lower position in FIGS. 5A and 5B below the two dielectric lines is used as a rotating center o, the dielectric line 12 will be moved in a direction yθ shown in FIG. 2. Nevertheless, such rotating center o may be optionally designated to any possible position.

Figure 6A:
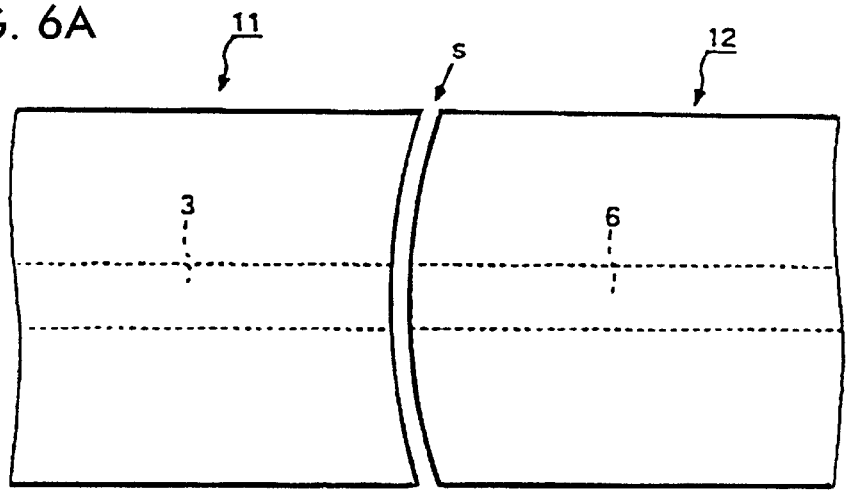
FIGS. 6A and 6B are explanatory views schematically indicating an example in which a dielectric line is moved in a plane parallel to conductive plates.
Figure 6B:
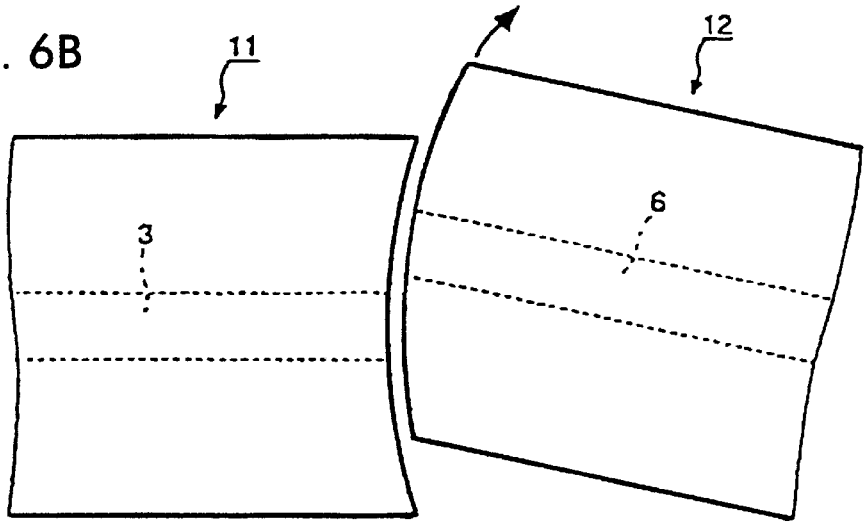

FIGS. 6A and 6B are explanatory views illustrating a switching operation which is effected by rotating the dielectric line 12 in a direction parallel to the conductive plates. AS shown in FIG. 6A, a dividing interface S between the dielectric lines 11 and 12 is similar to a side surface of a solid cylindrical member. As shown in FIG. 6B, by relatively rotating the dielectric line 12 with respect to the dielectric line 11, the dielectric strip 3 and the dielectric strip 6 will become staggered from each other so that they are not in their mutually facing positions, thereby stopping the propagation of an electromagnetic wave.

Figure 7:
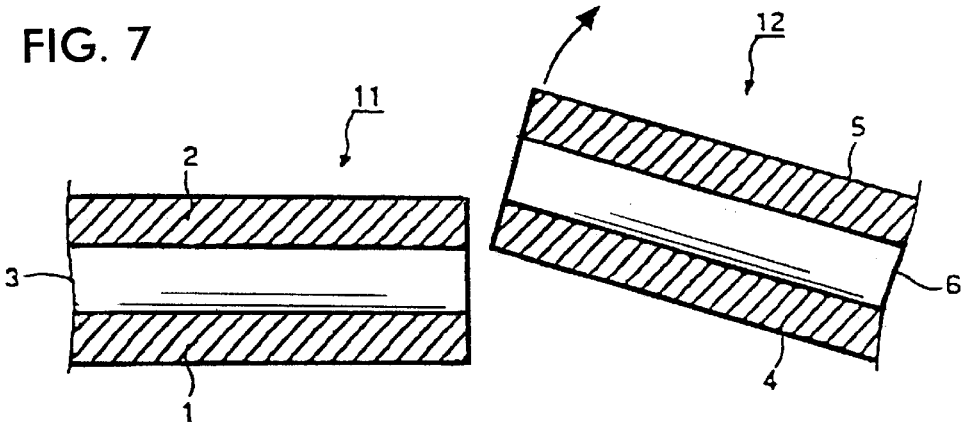
FIG. 7 is an explanatory view indicating another example in which a dielectric line is moved in a direction x.

FIG. 7 is an explanatory view indicating an example where the dielectric line 12 is rotated by a predetermined angle with a direction y serving as a rotating center axis. As shown in FIG. 7, by relatively rotating the dielectric line 12 with respect to the dielectric line 11, the dielectric strip 3 and the dielectric strip 6 will become staggered from each other so that they are not in their mutually facing positions, thereby effecting a desired switching operation. Similar to an example shown in FIG. 6B, it is also possible that a dividing interface between the dielectric lines 11 and 12 may be made similar to a side surface of a solid cylindrical member, with the rotating center of the dielectric line 12 serving as a central axis (of the virtual solid cylindrical member).

Several examples indicating a dielectric line switch will be described in detail as follows.

Figure 8A:
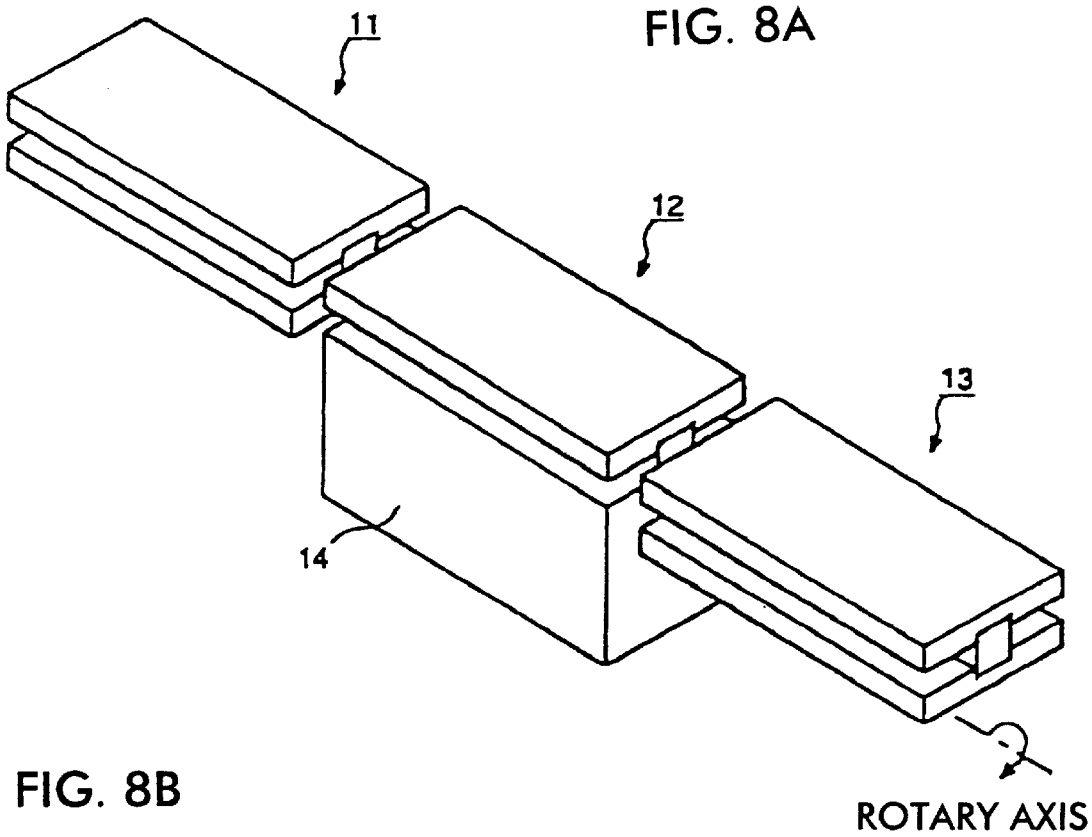
FIG. 8A is a perspective view schematically illustrating in more detail the basic structure of a dielectric line switch made according to another embodiment of the present invention.
Figure 8B:
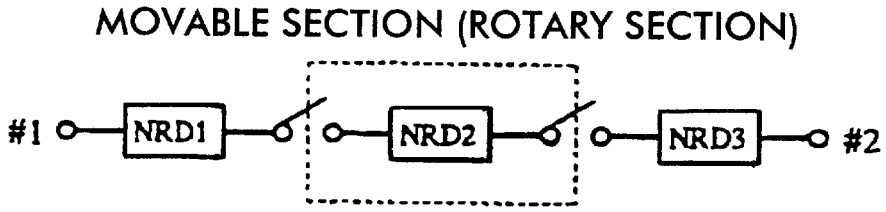
FIG. 8B is a block diagram indicating an equivalent circuit for the dielectric line switch shown in FIG. 8A.

FIGS. 8A and 8B illustrate an example where three dielectric lines 11, 12, 13 are arranged one by one in a lineal formation, and a switching operation may be effected by the rotation of the dielectric line 12. In FIG. 8, a reference numeral 14 represents a metal block serving as one conductive plate for the dielectric line 12, so that a dielectric stripe (not shown) may be interposed between the metal block 14 and its upper conductive plate. By rotating the dielectric line 12 with a central axis of the metal block 14 serving as a rotating center, an electromagnetic wave may be propagated in a condition as shown in the drawing. On the other hand, when the metal block 14 is rotated in a manner such that both ends of the dielectric line 12 become staggered away from the adjacent ends of the dielectric lines 11 and 13, the propagation of the electro-magnetic wave may be stopped.

FIG. 8B is a block diagram indicating an equivalent circuit for the dielectric lines 11, 12 and 13 arranged in a manner shown in FIG. 8A. In FIG. 8B, NRD1, NRD2 and NRD3 correspond to the dielectric lines 11, 12 and 13. Upon rotating the metal block 14, two switches on both ends of the NRD 2 simultaneously become ON/OFF. In this way, a dielectric line switch is formed between two fixed ports #1 and #2. In the example shown in FIG. 8A, the upper and lower conductive plates of each dielectric line are arranged to face each other. Each conductive plate has a groove formed on its inner surface, so that a dielectric stripe may be received and located in the grooves of two mutually faced conductive plates.

Figure 9:
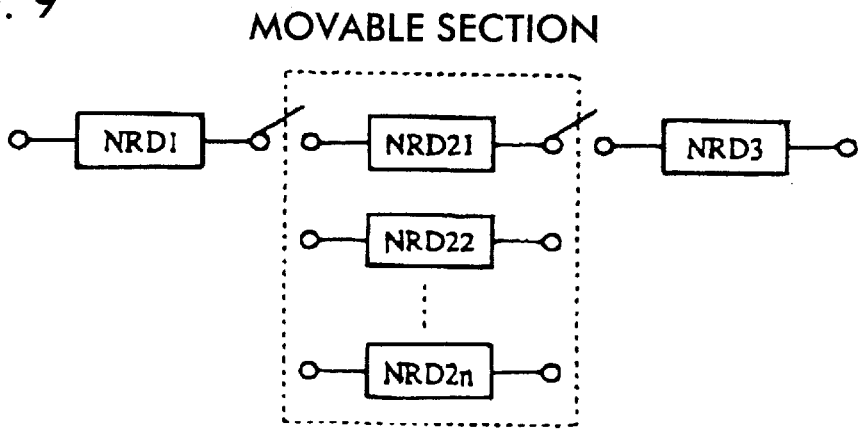
FIG. 9 is a block diagram indicating an equivalent circuit for the dielectric line switch shown in FIG. 8A.

Although it has been illustrated in FIG. 8A that one of the surfaces of the metal block 14 is used to serve as one conductive plate for the dielectric plate 12, it is also possible that all the surfaces or at least several side surfaces of the metal block 14 may be similarly treated so that each of them can act as a conductive plate, thereby forming another arrangement of several dielectric lines including NRD1 and NRD3, and further including a plurality of dielectric lines NRD21, NRD22 . . . NRD2*n* which may be selectively chosen so as to be inserted in a position between the NRD1 and NRD3, as indicated in FIG. 9 showing an equivalent circuit for such an arrangement of the several (more then three) dielectric lines.

Figure 10:
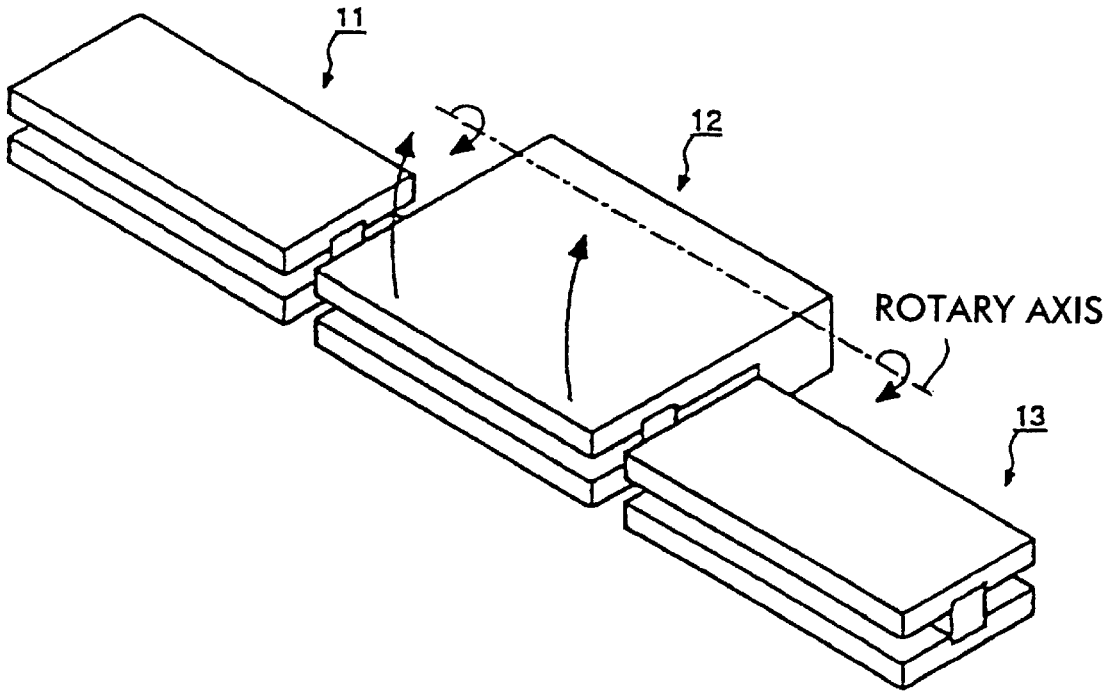
FIG. 10 is a perspective view schematically illustrating a dielectric line switch.

FIG. 10 is a perspective view indicating a plurality of dielectric lines 11, 12 and 13, but the dielectric line 12 has its rotating central axis arranged along one side, a position that is different from that in FIG. 8A. As shown in FIG. 10, since a substantially middle space between the two conductive plates of the dielectric line 12 is used as a rotating axis, a dielectric strip of the dielectric line 12 will move in a direction xθ. Further, although it has been described in the above that the dielectric line 12 is caused to have a rotating movement, it is also possible that the dielectric line 12 may be caused to have an oscillating movement within a predetermined angle.

Figure 11:
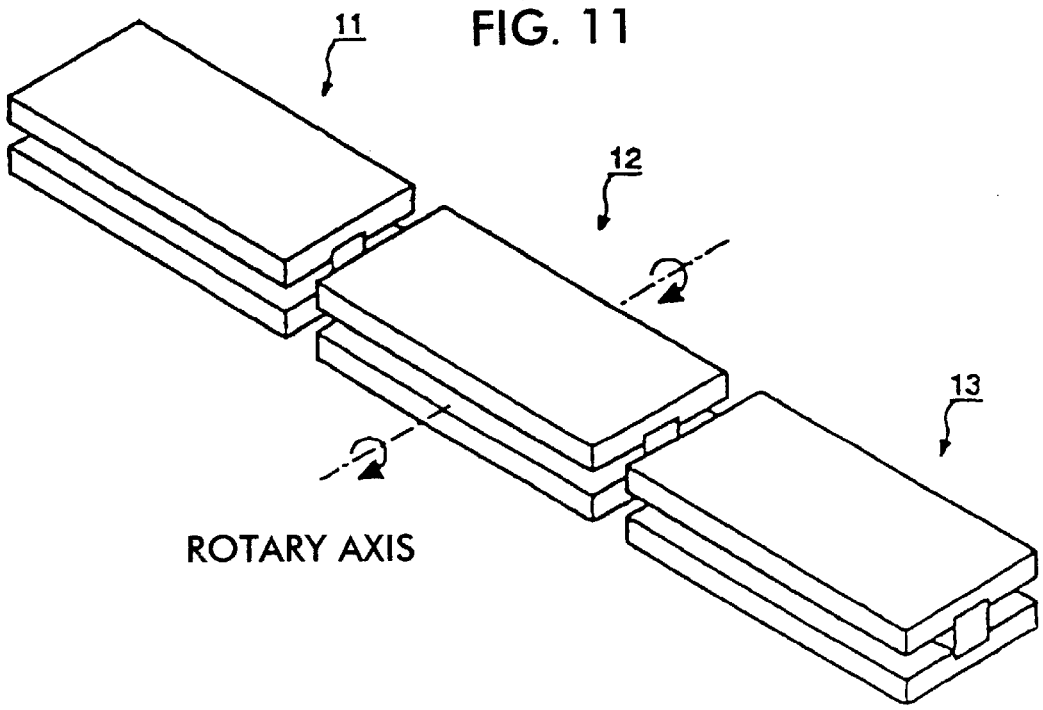
FIG. 11 is a perspective view schematically illustrating a dielectric line switch.

FIG. 11 is a perspective view indicating a plurality of dielectric lines 11, 12 and 13, but the dielectric line 12 has its rotating central axis arranged in parallel with the direction y. As shown in FIG. 10, the dielectric line 12 may be rotated in a direction as shown in FIG. 11, in a manner such that one end face thereof facing the dielectric line 11 is moved upwardly, and another end face thereof facing the dielectric line 13 is moved downwardly.

Figure 12A:
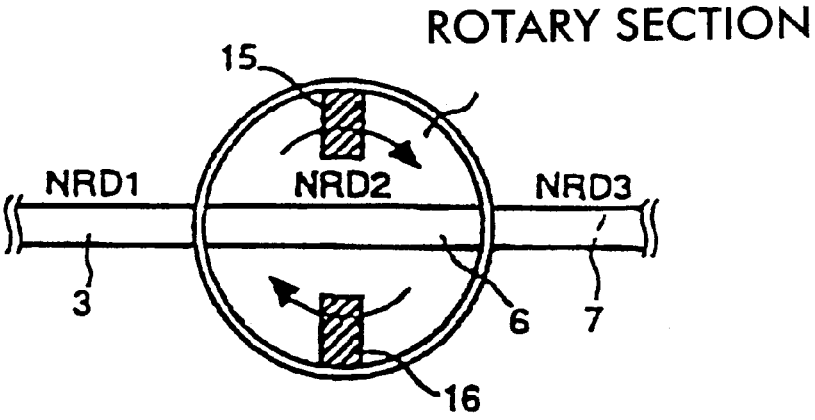
FIGS. 12A and 12B are plane views indicating a dielectric line switch.
Figure 12B:
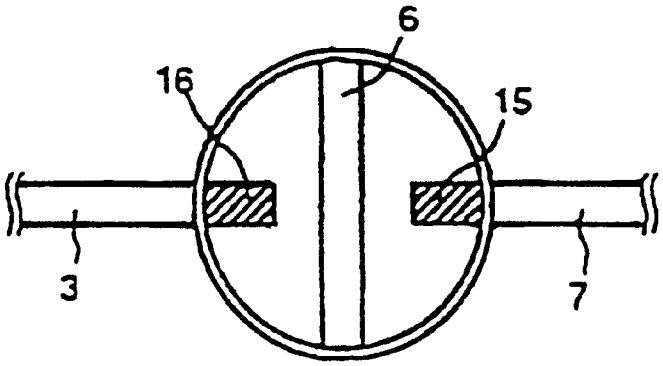

FIGS. 12A and 12B are explanatory views indicating an example where a dielectric line is rotated in a direction parallel to the conductive plates, but with the upper conductive plate taken away from the drawings for the sake of an easy explanation. As shown in FIG. 12A, when a dielectric strip 6 of a rotary section is in a position facing on both sides thereof adjacent strips 3 and 7, an electromagnetic wave is allowed to propagate therethrough. On the other hand, when the rotary section is rotated by 90 degrees, as shown in FIG. 12B, the propagation of the electromagnetic wave will be stopped. Further, the rotary section is provided with a pair of terminators 15, 16. When in an OFF condition as shown in FIG. 12B, the dielectric strips 3 and 7 will be terminated with an effect of the terminators 15 and 16. As a result, an electromagnetic wave propagating through the dielectric strip 3 will be terminated by the terminator 16, whilst an electromagnetic wave propagating through the dielectric strip 7 will be terminated by the terminator 15, thereby prohibiting an undesired reflection.

Figure 13A:
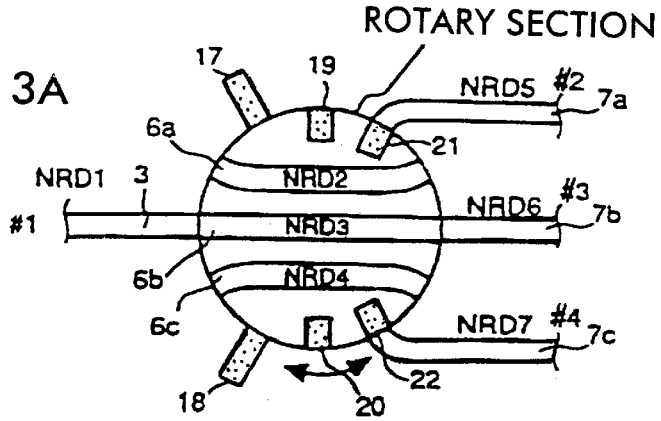
FIGS. 13A–13C are plane views indicating a dielectric line switch.
Figure 13B:
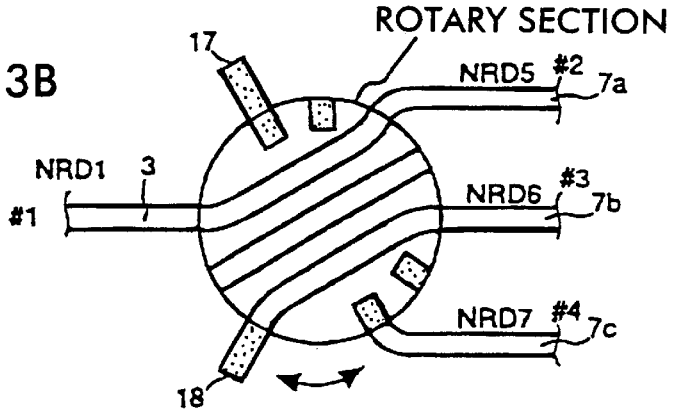
Figure 13C:
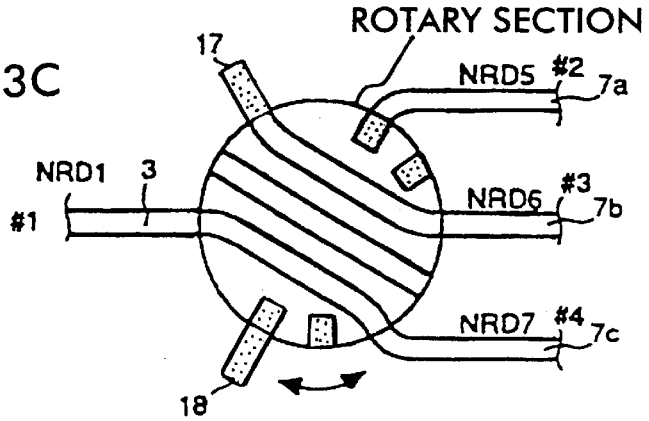
Figure 13D:
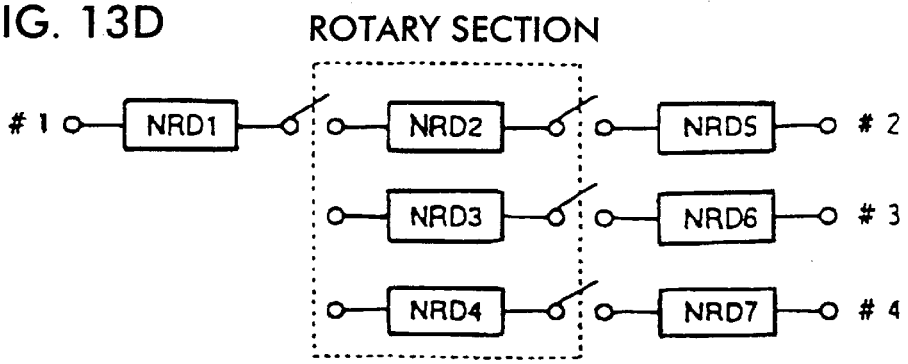
FIG. 13D is a block diagram indicating an equivalent circuit for a dielectric line switch.

FIGS. 13A–13C are explanatory views indicating another example where a desired switching operation may be effected by rotating a dielectric line in a direction parallel to the conductive plates, but with the upper conductive plate taken away from the drawings for the sake of an easy explanation. FIG. 13D is a block diagram indicating an equivalent circuit. As shown in FIG. 13A, a stationary section is connected with four dielectric strips represented by reference numerals 3, 7*a*, 7*b*, 7*c*, and two terminals represented by reference numerals 17, 18. A rotary section is provided with three dielectric strips represented by reference numerals 6*a*, 6*b*, 6*c*, and four terminators represented by reference numerals 19–22. In a condition shown in FIG. 13A, since a dielectric strip 6*b* is inserted in a position between the two dielectric strips 3 and 7*b*, it is possible for an electromagnetic wave to propagate between the port #1 and the port #3. The dielectric strips 7*a* and 7*c* are connected with the terminators 21 and 22, so as to be terminated thereon. If the rotary section is rotated in a counterclockwise direction by a predetermined angle to arrive at a position shown in FIG. 13B, since a dielectric strip 6*a* is inserted in a position between the dielectric strips 3 and 7*a*, it is possible for an electromagnetic wave to propagate between the port #1 and the port #2. The dielectric strips 7*b* and 7*c* are connected with the terminators 18 and 20, so as to be terminated thereon. If the rotary section is rotated in a clockwise direction by a predetermined angle to arrive at a position shown in FIG. 13C, since a dielectric strip 6*c* is inserted in a position between the dielectric strips 3 and 7*c*, it is possible for an electromagnetic wave to propagate between the port #1 and the port #4. The dielectric strips 7*a* and 7*b* are connected with the terminators 19 and 17, so as to be terminated thereon.

The rotation of the above dielectric line may be controlled through a manual operation, but if a DC motor or a stepping motor is used, it is possible to control the switching operation of the dielectric line by means of an electric control.

FIG. 13D is a block diagram showing an equivalent circuit for the above arrangements shown in FIGS. 13A–13C.

Figure 14A:
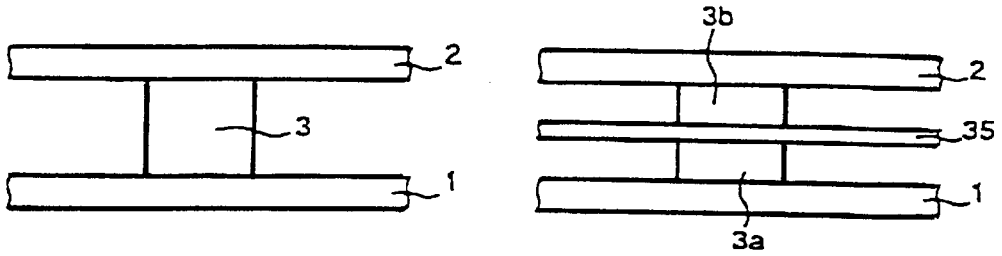
FIGS. 14A–14D are explanatory views schematically indicating various types of dielectric lines.
Figure 14B:
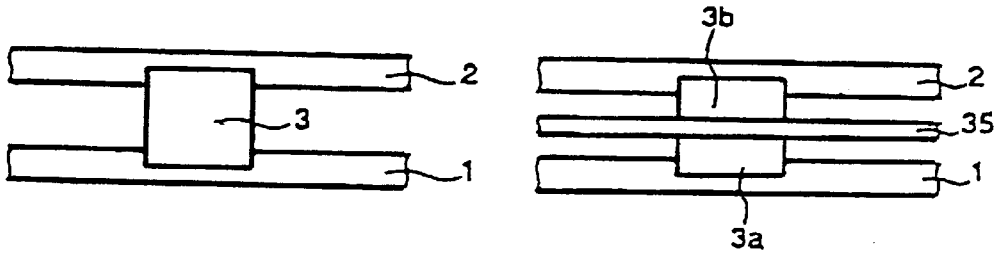
Figure 14C:
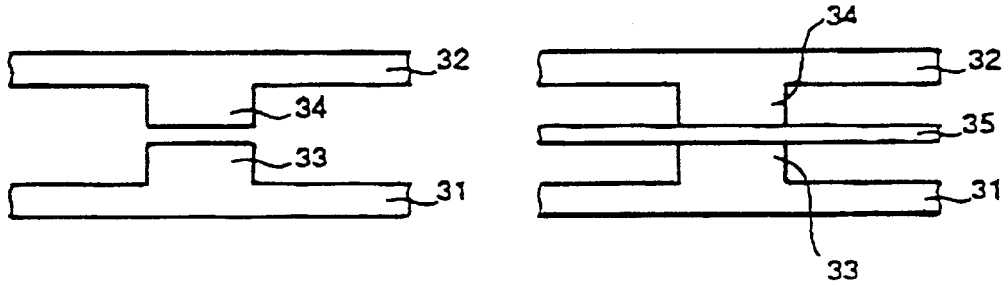
Figure 14D:
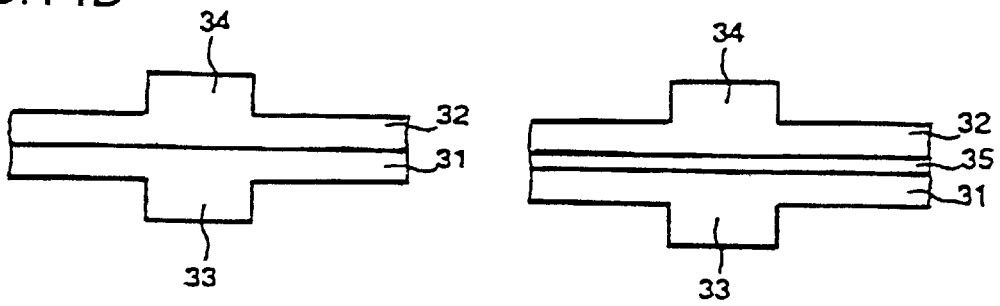

Although it has been described in the above examples that a dielectric strip is interposed between two conductive plates so as to form a dielectric line, it is also possible to form various other kinds of structures. FIGS. 14A–14D are cross sectional views indicating several different structures of different dielectric lines. FIG. 14A shows a normal type dielectric line. FIG. 14B shows a grouped type dielectric line. FIG. 14C shows a winged type dielectric line. As shown in FIG. 14C, two dielectric strips 33 and 34 are formed on predetermined positions on two dielectric plates 31, 32. In fact, the outer surface of each of the dielectric plates 31, 32 is coated with a conductive film. Thus, a propagation route for passing an electromagnetic wave may be formed by rendering the two dielectric strips to face each other. FIG. 14D indicates a dielectric line of a further configuration in which two dielectric strips 33 and 34 are protrudingly formed on the outer surfaces of two dielectric plates 31, 32, the outer surface of each of the dielectric plates 31, 32 is coated with a conductive film. What is illustrated on the right side of FIG. 14D is a dielectric line together with a millimeter wave circuit, in which a circuit substrate board 35 is interposed between two conductive plates arranged in a mutually parallel manner.

Several dielectric line devices each using a dielectric line switch, will be described in detail below.

Figure 15:
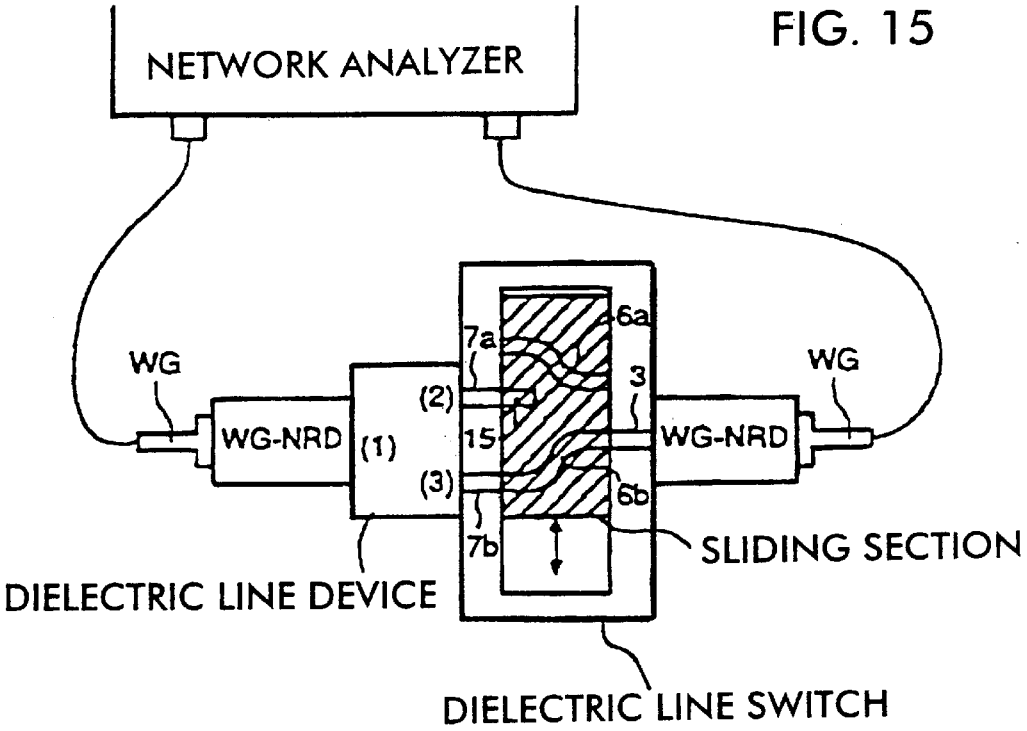
FIG. 15 is an explanatory view schematically illustrating the constitution of a dielectric line switch for use in a characteristic measuring instrument of a dielectric line device.

FIG. 15 is an explanatory view illustrating a dielectric line switch for use in a characteristic measuring instrument of a dielectric line device. Referring to FIG. 15, WG is a wave guide, WG-NRD is a converter of wave guide/dielectric line. As shown in FIG. 15, a dielectric line switch is employed in order to evaluate the characteristics of a three-port dielectric line device with the use of a network analyser of a two-port measuring instrument. The dielectric line switch is shown in FIG. 15 with its upper conductive plate taken away for the sake of an easy explanation. Referring again to FIG. 15, the dielectric line switch includes stationary dielectric strips 7*a*, 7*b*, 3, further includes slidable dielectric strips 6*a*, 6*b* and a terminator 15. Under a condition shown in FIG. 15, the dielectric strips 3 and 7*b* are connected with each other through a dielectric strip 6*b*. The dielectric strip 7*a* is connected with the terminator 15. If a sliding section (shown by a hatched portion in FIG. 15) is moved down, the dielectric strips 3 and 7*a* will be connected with each other through the dielectric strip 6*a*, and the dielectric strip 7*b* will get connected with the terminator 15.

Figure 16A:
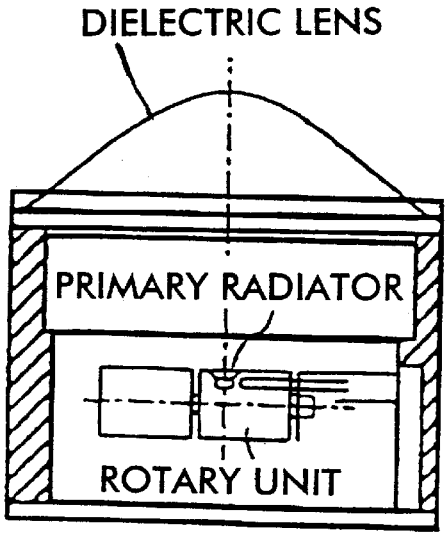
FIGS. 16A and 16B are explanatory views illustrating an internal structure of a radar module.
Figure 16B:
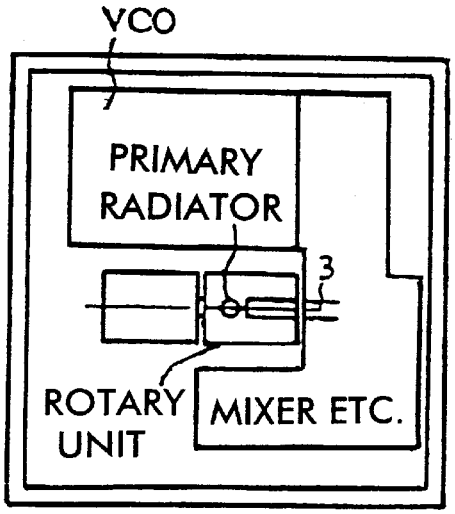

FIGS. 16A and 16B are used to illustrate the structure of a radar module. FIG. 16A is a cross sectional view illustrating the radar module. FIG. 16B is a top plane view also showing the radar module, but with its dielectric lens taken away for the sake of an easy explanation. As shown in FIG. 16B, within the radar module is provided a VCO, a mixer, a rotary unit and a motor for rotating the rotary unit. The rotary unit has a plurality of primary radiators. Thus, with the rotation of the rotary unit, the positions of the primary radiators, corresponding to the focal point of the dielectric lens, will be changed alternatively in a predetermined manner.

Figure 17A:
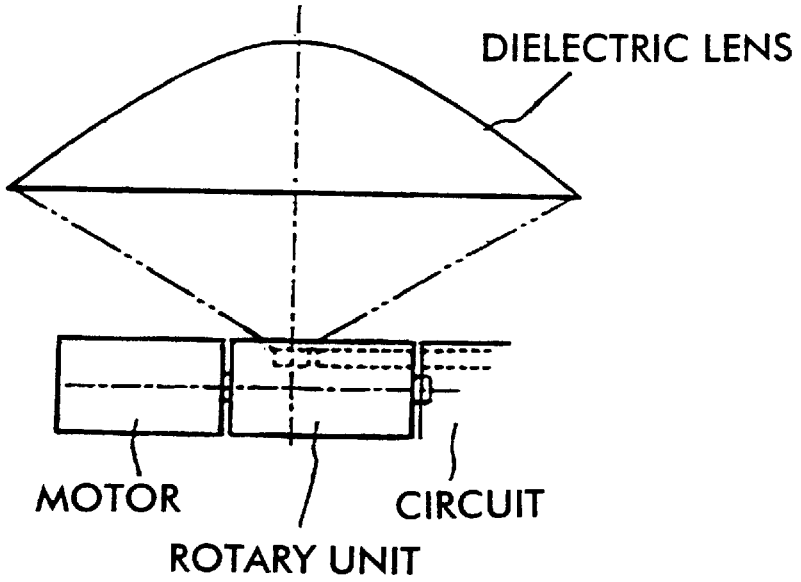
FIGS. 17A and 17B are a side view and a perspective view, respectively, illustrating the structure of a rotary unit.
Figure 17B:
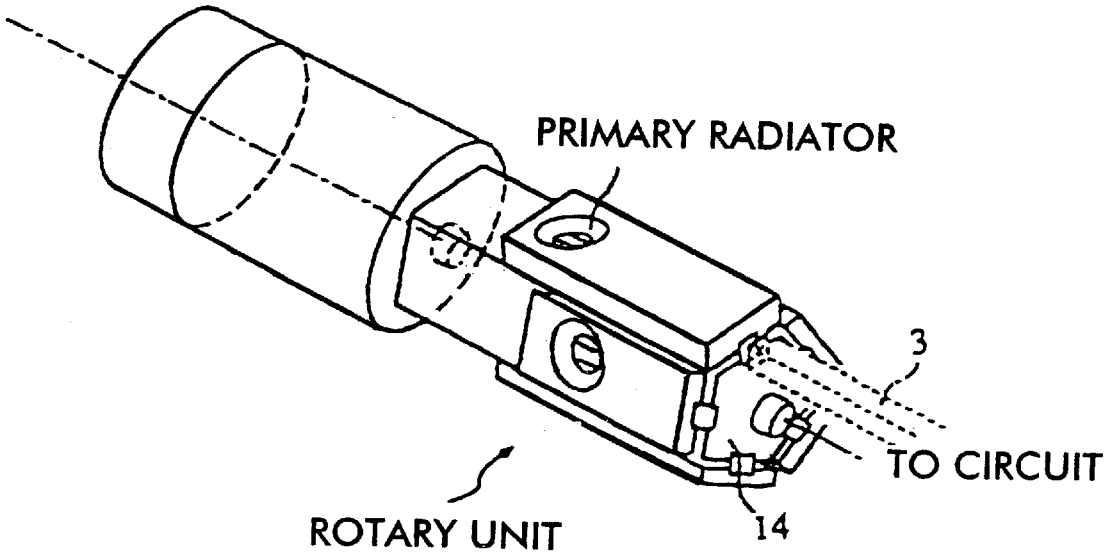

FIGS. 17A and 17B are explanatory views illustrating the structure of the above rotary unit and a positional relationship between the rotary unit and the dielectric lens. As shown in FIGS. 17A and 17B, a dielectric line includes a normal pentagonal metal block 14 having five side faces, a plurality of conductive plates in parallel with the five side surfaces, a plurality of dielectric strips each interposed between one conductive plate and one side face of the metal block 14. Further, between each side face of the metal block 14 and each parallel conductive plate, there is provided a dielectric resonator so as to serve as a primary radiator.

Figure 18A:
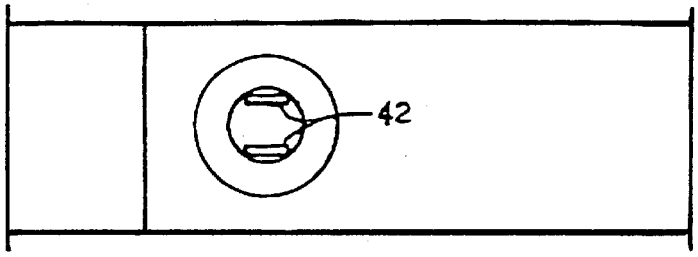
FIGS. 18A and 18B are a plane view and a cross sectional view, respectively, illustrating the structure of a primary radiator.
Figure 18B:
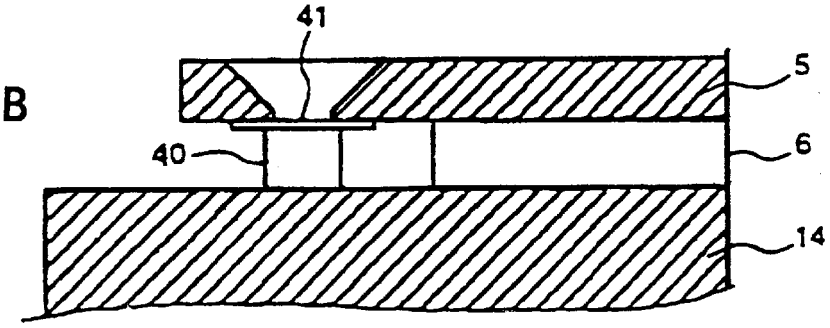

FIGS. 18A and 18B are used to illustrate the structures of a dielectric line and a primary radiator of the above rotary unit. FIG. 18A is a top plane view, FIG. 18B is a cross sectional view. In FIG. 18B, a reference numeral 40 is used to represent a dielectric resonator of HE111 mode having a solid cylindrical shape, which is provided in a position separated a predetermined distance from an end portion of a dielectric strip 6. As shown in FIG. 18B, a conical window is formed through one portion of a conductive plate 5, in a manner such that it is possible to effect an emission from and an incidence to the upper side above the dielectric resonator 40. Further, a strip 41 is disposed between the dielectric resonator 40 and the conductive plate 5, so that the strip 41 may be used to control the pattern of an radiation of an electro-magnetic wave.

Figure 19:
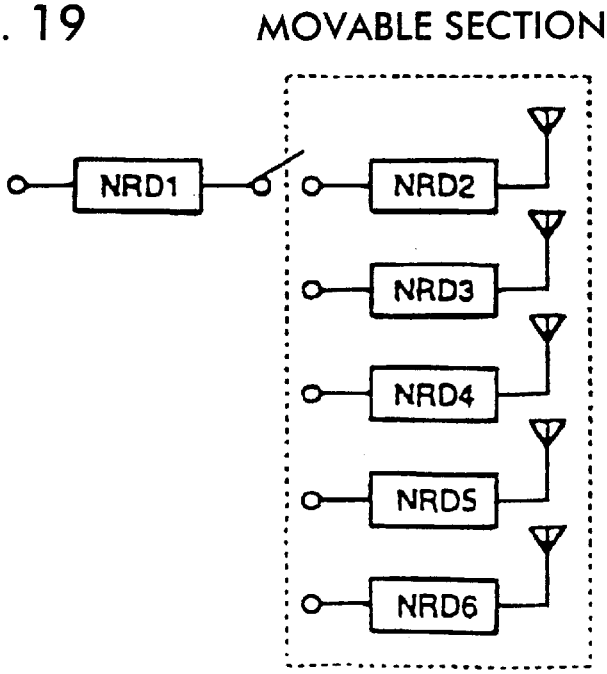
FIG. 19 is a block diagram indicating an equivalent circuit for the rotary unit of the radar module of FIG. 16.

FIG. 19 is a block diagram indicating an equivalent circuit for the above rotary unit. As shown in FIG. 19, NRD1 is used to represent a dielectric line on a fixed side with respect to the rotary unit, while NRD2–NRD6 are used to represent dielectric lines on the side of the rotary unit. In this way, a plurality of dielectric lines and primary radiators are formed on the rotary unit, by rotating the rotary unit with the use of a motor, the primary radiators are alternatively turned up so as to function in a desired manner.

Figure 20:
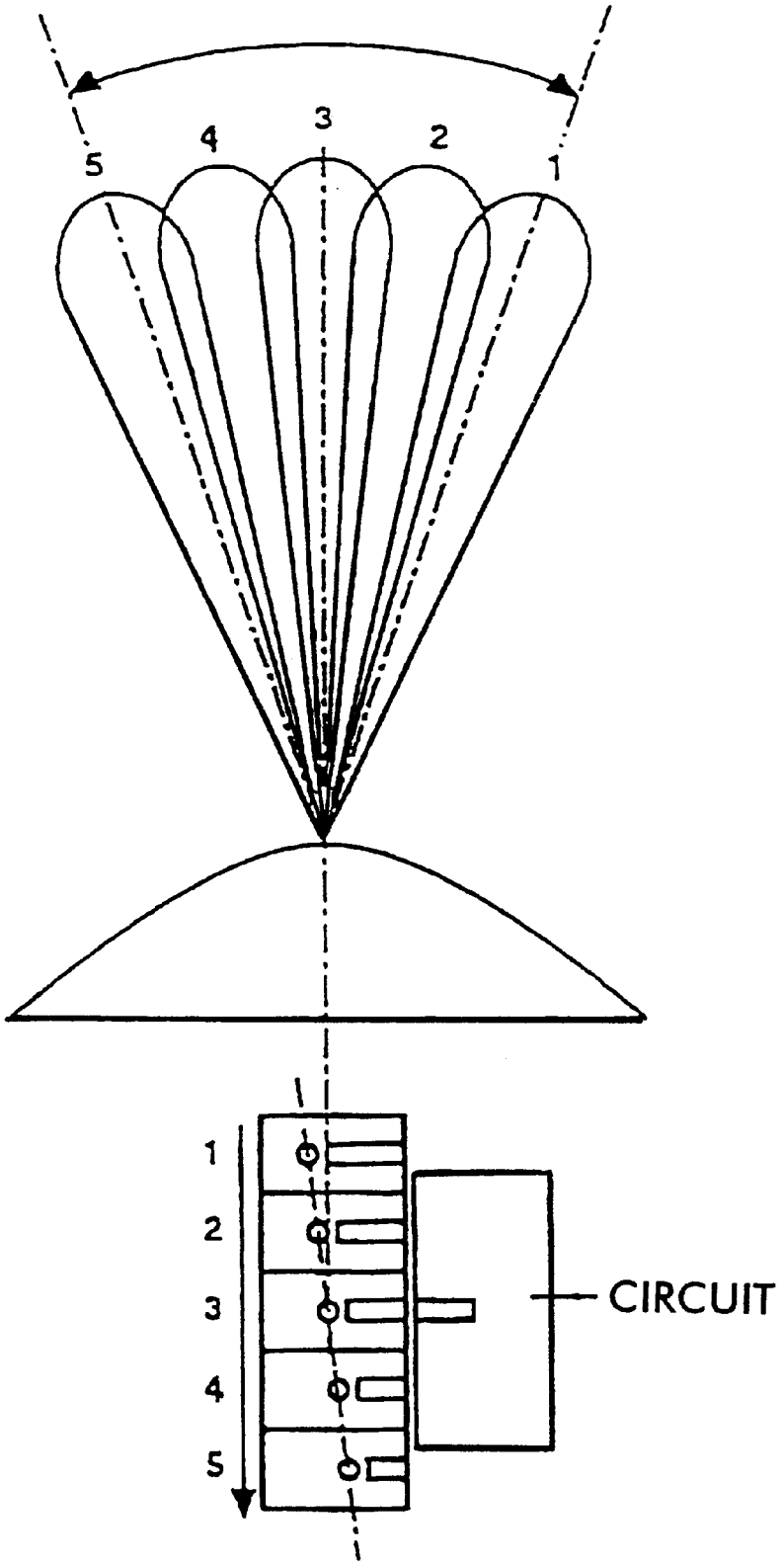
FIG. 20 is an explanatory view illustrating a condition of beam scanning during the rotation of a rotary unit.

FIG. 20 is an explanatory view illustrating a positional relationship between a dielectric lens and primary radiators. As shown in FIG. 20, the rotary unit is virtually developed so that all its side faces are arranged in an identical plane. In this way, if the primary radiators are disposed at slightly different positions in the left/right direction on the drawing, the rotation of the rotary unit will cause the beam direction to be changed (in the left/right direction on the drawing) through five stages. Further, since a position deviation (an off-set distance) of a primary radiator will neither affect the size of the primary radiators, nor bring any unfavourable influence to an interval distance between every two adjacent primary radiators, it is possible to freely and optionally set an off-set distance.

Figure 36:
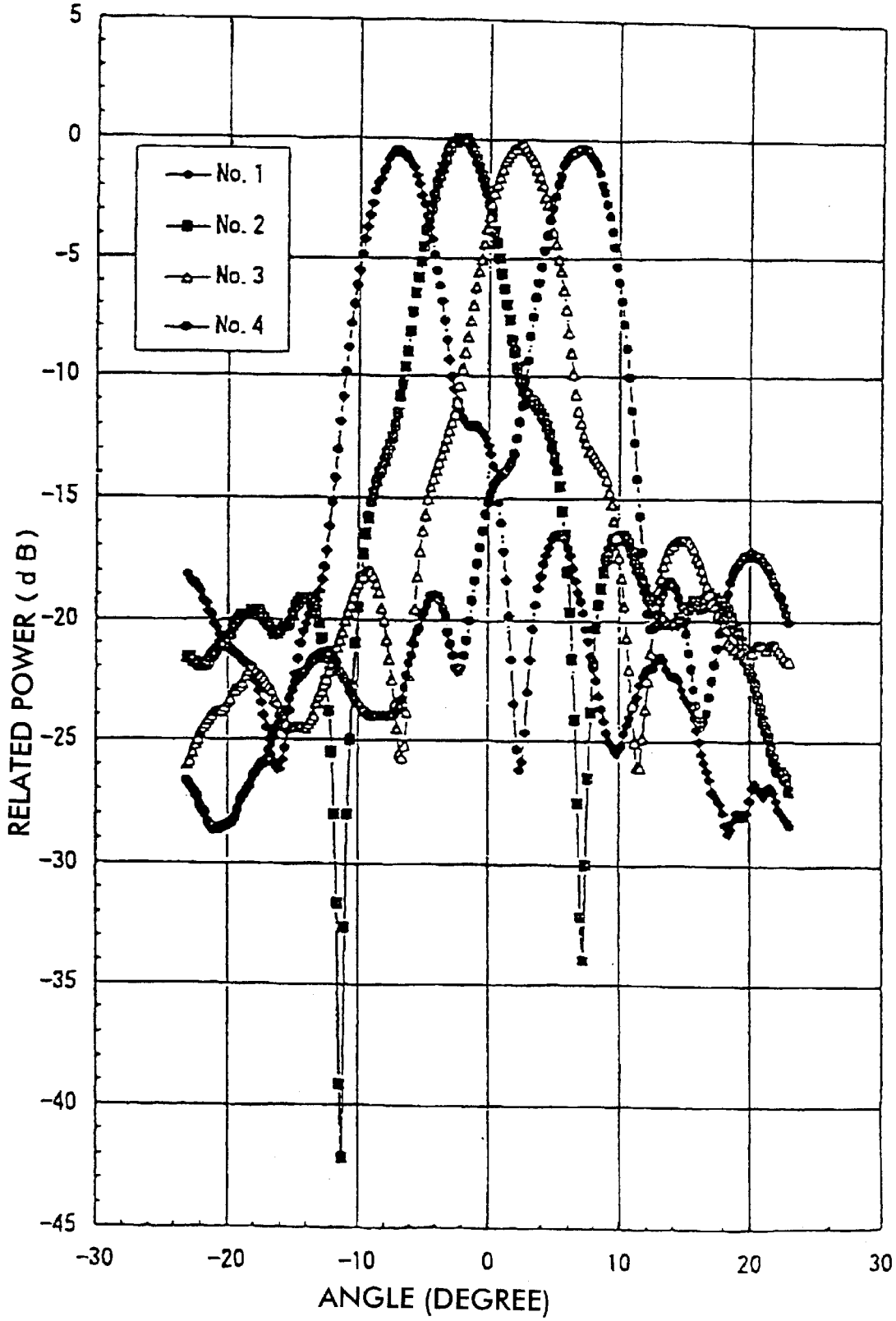
FIG. 36 is a graph indicating a directivity of a beam when an off-set distance is changed in four stages.
Figure 37A:
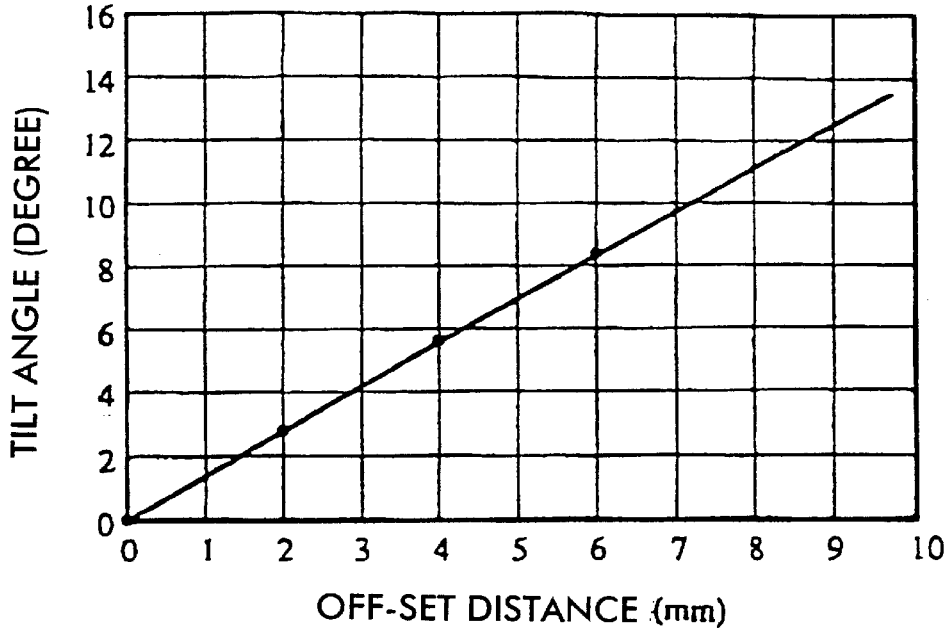
FIGS. 37A and 37B are a graph and an explanatory view, indicating a relationship between an off-set distance and a tilt angle.
Figure 37B:
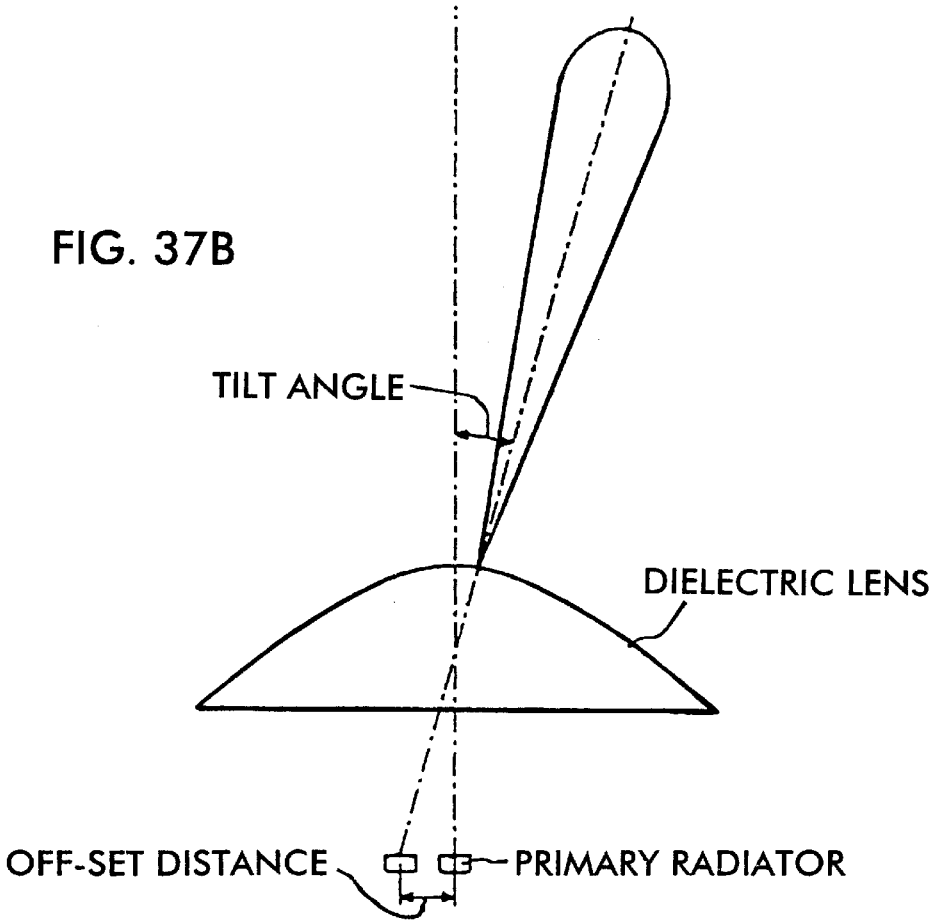
Figure 38A:
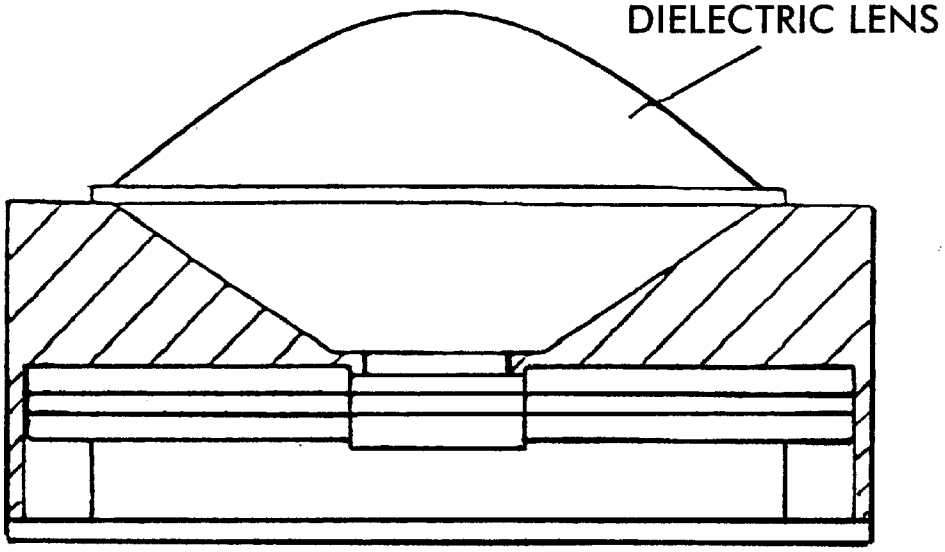
FIGS. 38A and 38B are explanatory views indicating the structure of a radar module made according to a prior art.
Figure 38B:
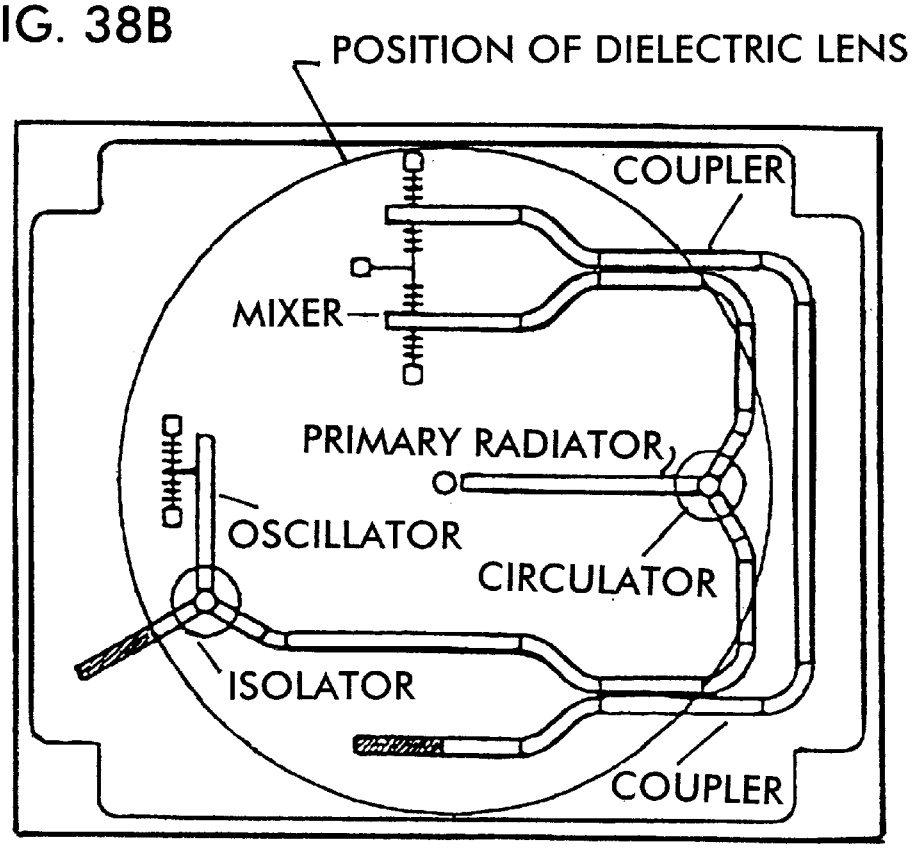

FIGS. 36 and 37 are used to show an example of a directional characteristic of a beam when an off-set distance has been changed. In particular, FIG. 37 is used to indicate a relationship between an off-set distance and an tilt angle under a condition using a dielectric lens having a diameter of 75 mm. As can be seen from FIG. 37, when an off-set distance is sufficiently short as compared with the diameter of the dielectric lens, an off-set distance will become proportional to a tilt angle. In this way, the off-set distance may be discretely and alternatively changed at an equal interval, thereby rendering the beam direction to be alternatively changed at an equal angular interval. FIG. 36 is used to indicate a directivity of a beam when an off-set distance is caused to change through four stages. The mesial magnitude angle (degree) and tilt angle (degree) of beams No. 1–No. 4 are indicated in the flowing Table.

| | No. 1 | No. 2 | No. 3 | No. 4 |
|---|---|---|---|---|
| Mesial Magnitude (Degree) | 4.8 | 4.7 | 4.7 | 4.7 |
| Tilt Angle (Degree) | −7.0 | −2.3 | 2.4 | 7.1 |
| Tilt Angle Difference | 4.7 | 4.7 | 4.7 | |

As is understood from the above Table, the beam directivity will have almost no deflection if an off-set distance is changed within a predetermined range. As can also be seen from the graph shown in FIG. 36, side drops will not become large.

Figure 21A:
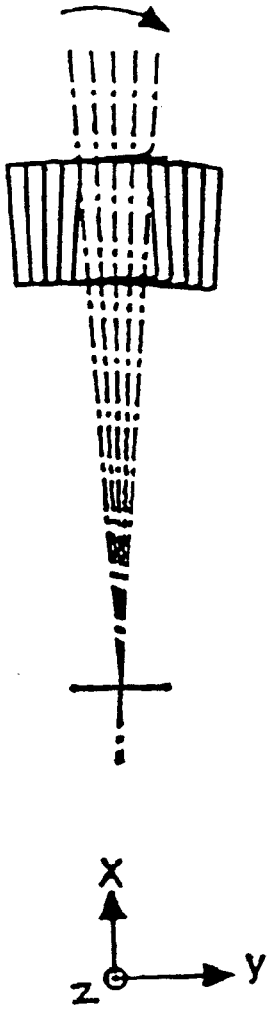
FIGS. 21A and 21B are explanatory views illustrating a deviation between two mutually facing dielectric strips.
Figure 21B:
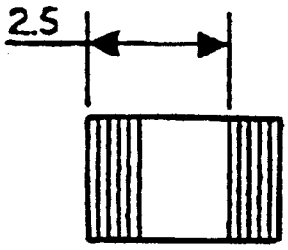

A change in characteristics of electromagnetic wave propagating course will be indicated in FIGS. 21A and 21B. In fact, such change will occur when the above rotary unit is rotated and two mutually facing dielectric strips are staggered from each other.

Figure 22A:
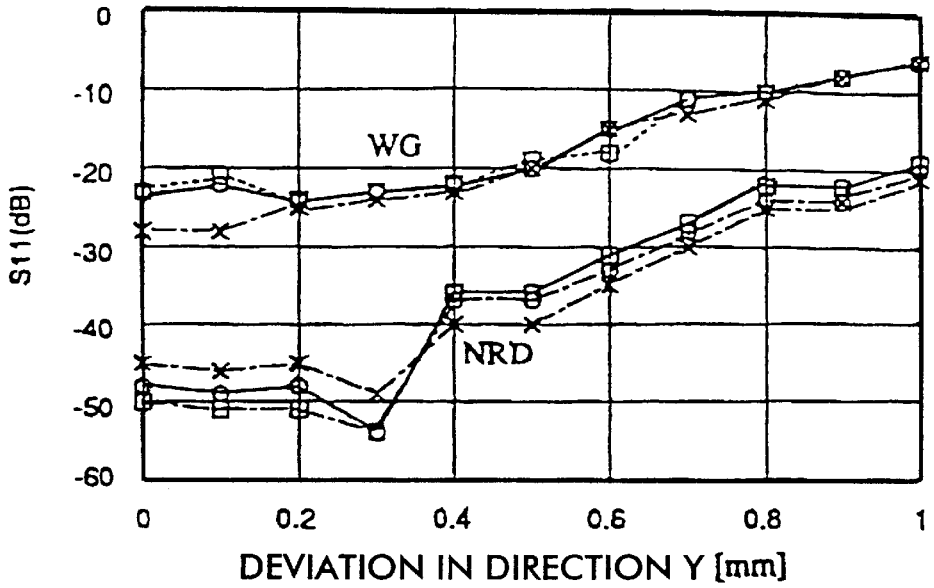
FIGS. 22A and 22B are graphs indicating the change of characteristics caused due to deviations of a dielectric line and a wave guide.
Figure 22A:
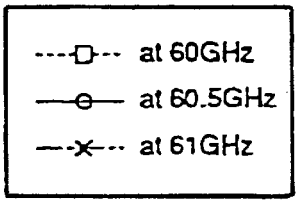
Figure 22B:
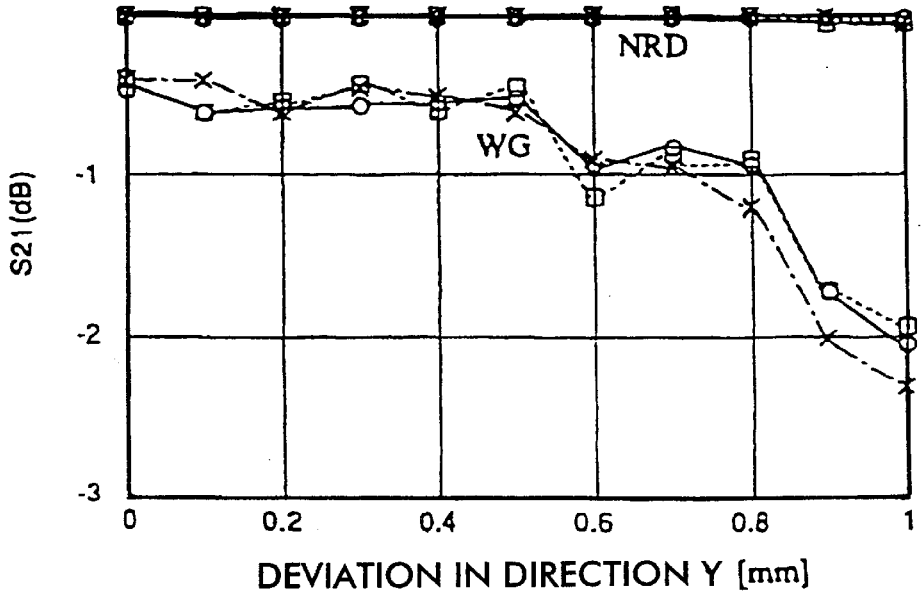

FIG. 21A is used to illustrate an aberration of a dielectric strip when a dielectric line has been moved in a direction yθ. FIG. 21B is used to illustrate an aberration of a dielectric strip when a dielectric line has been moved straightly forward in a direction y, a situation that may be considered substantially equivalent to a condition shown in FIG. 21A. FIG. 22A is used to indicate changes of characteristics in a normal type dielectric line shown in FIG. 21B, FIG. 22B is used to indicate the changes of characteristics in a wave guide (for use as a comparative example). Here, NRD represents a condition associated with a dielectric line, and WG represents a condition associated with a wave guide. As can be seen in FIGS. 22A and 22B, when a dielectric line has an aberration of 0–1.0 mm in a direction y, an SII characteristic will be −20 dB or lower, an S21 characteristic will become 0 dB, thereby proving that such an aberration does not bring any unfavourable influence to an propagation characteristic for an electromagnetic wave to pass therethrough. On the other hand, when a wave guide has an aberration of 0–1.0 mm in a direction y, the S11 characteristic will decrease from −20 dB to −6 dB. When a wave guide has an aberration of up to 0.8 mm in a direction y, the S21 characteristic will be maintained at −1 dB or higher, but will suddenly drop (decrease) once the aberration exceeds 0.8 mm.

In this way, a dielectric line, as compared with a wave guide, is not likely to cause a reflection. This is because even if a dielectric line has a slot formed between two conductors, an electric current will not be stopped by such slot. Further, with a dielectric line, even if it has an aberration in a direction y, such aberration will hardly cause any unfavourable influence since a dielectric strip will function in a desired manner, thereby ensuring a propagation of electromagnetic wave with a low loss. With a wave guide, it is necessary to provide a choke structure in order to reduce an influence caused by a slot formed at a junction. However, with a dielectric line, such a choke structure is not necessary.

Figure 23A:
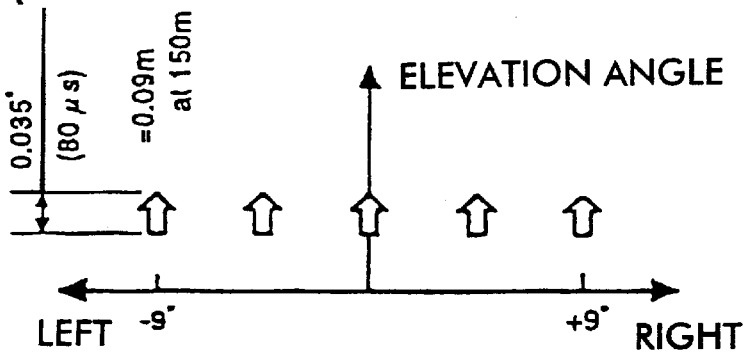
FIGS. 23A and 23B indicate timing charts obtained during the rotation of a rotary unit.
Figure 23B:
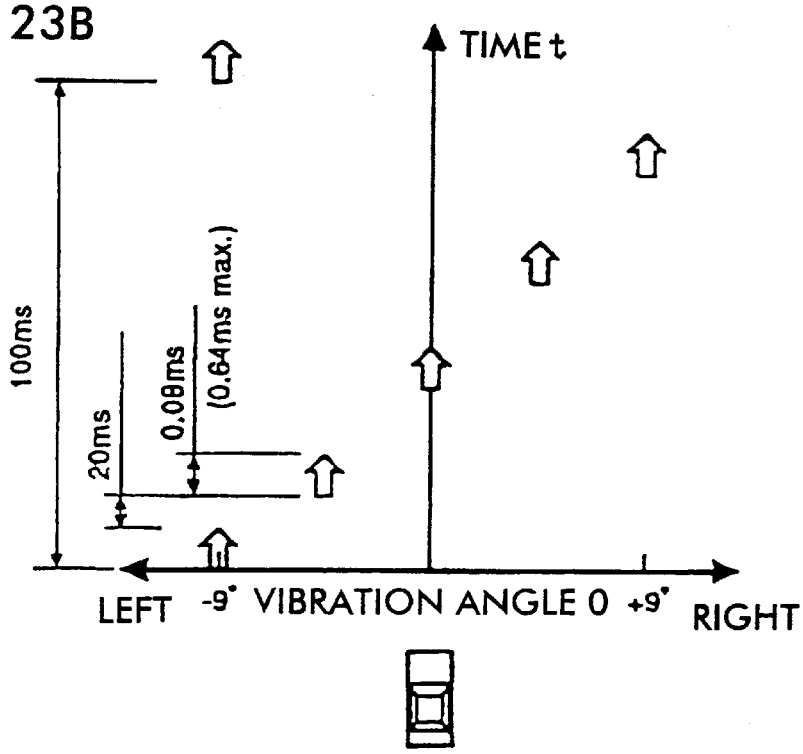
Figure 23C:
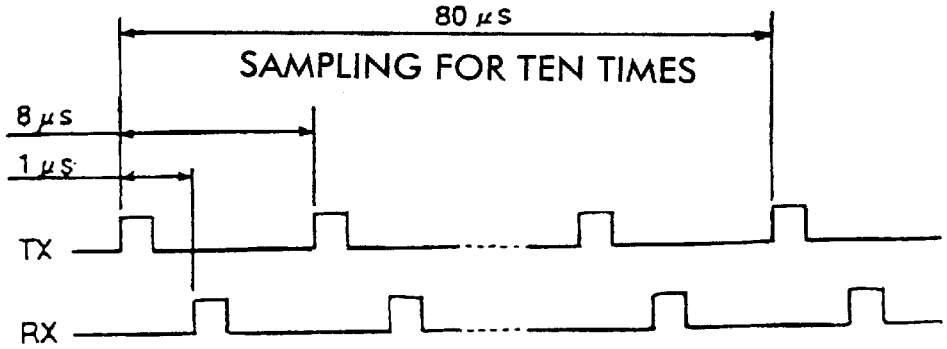

Under a condition where a normal pentagonal rotary unit is rotated at an angular velocity of 600 rpm and a primary radiator has been selected (during a time period when the primary radiator is in an actually connected state), a sampling process may be performed for ten times with the use of pulse method, as shown in FIGS. 23A and 23B. For example, when a beam scanning is performed for every mesial magnitude 4.5°, a beam vibration angle will be in a range from −9° to +9°, a connection time of a primary radiator will be 0.64 ms at most, thereby effecting electromagnetic wave transmission and reception for ten times, as shown in FIG. 23A. Further, as shown in FIG. 23B, it is also sufficient to perform electromagnetic wave transmission and reception with an 8 μs period. Here, since each primary radiator is selected while the rotary unit is continuously rotated, the beam scanning will be some how in an elevation angle direction during a time when each primary radiator is used to perform electromagnetic wave transmission and reception. Since such elevation angle is formed when the center of a beam is moved for 0.09 m to a position 150 m ahead, this kind of beam center movement will not present any problem.

Figure 24A:
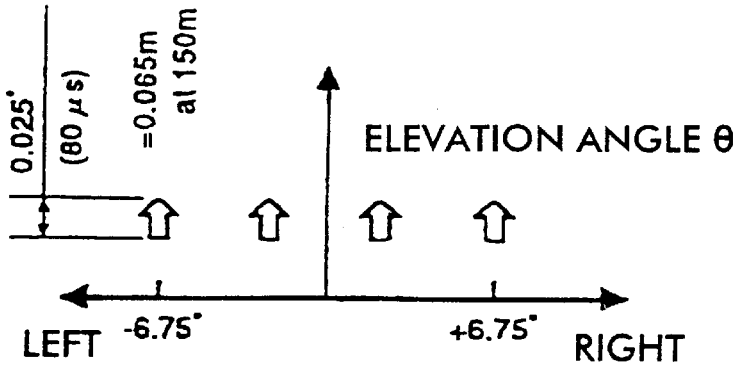
FIGS. 24A–24C indicate timing charts obtained during the rotation of a rotary unit.
Figure 24B:
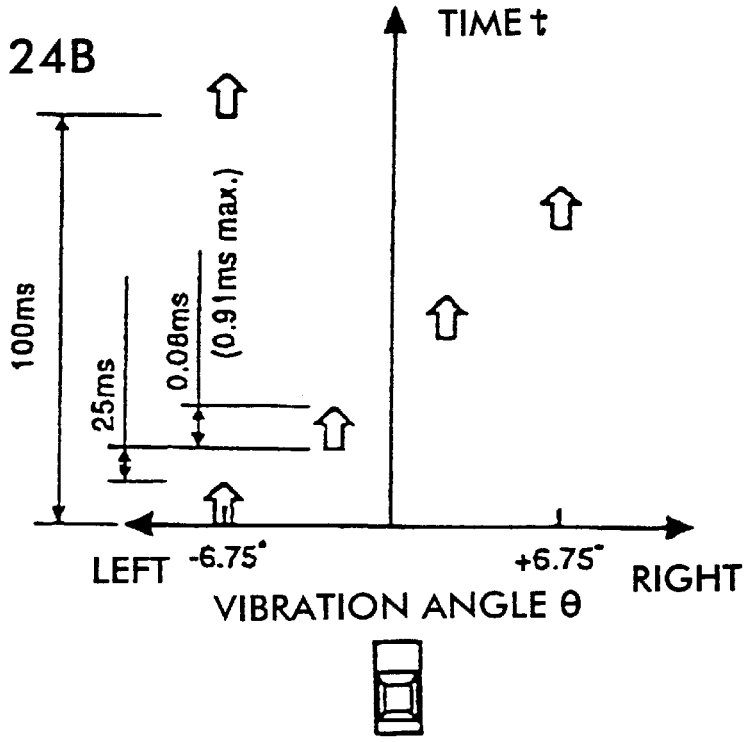
Figure 24C:
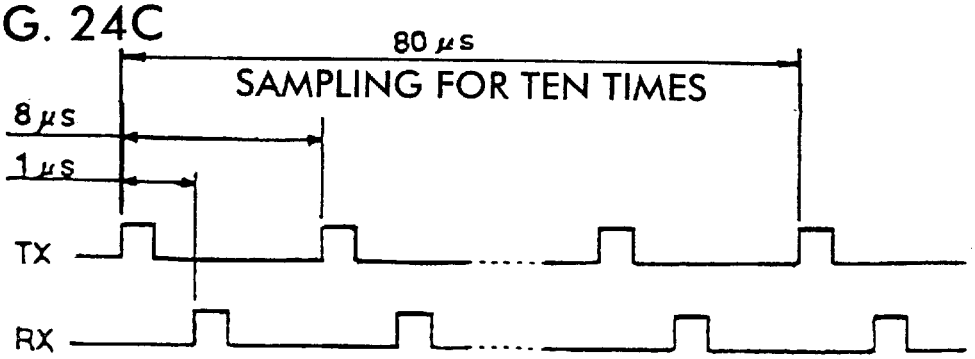

FIGS. 24A, 24B, 24C are used to indicate an example of using a rotary unit comprising a square metal block provided with dielectric lines and primary radiators.

Figure 25:
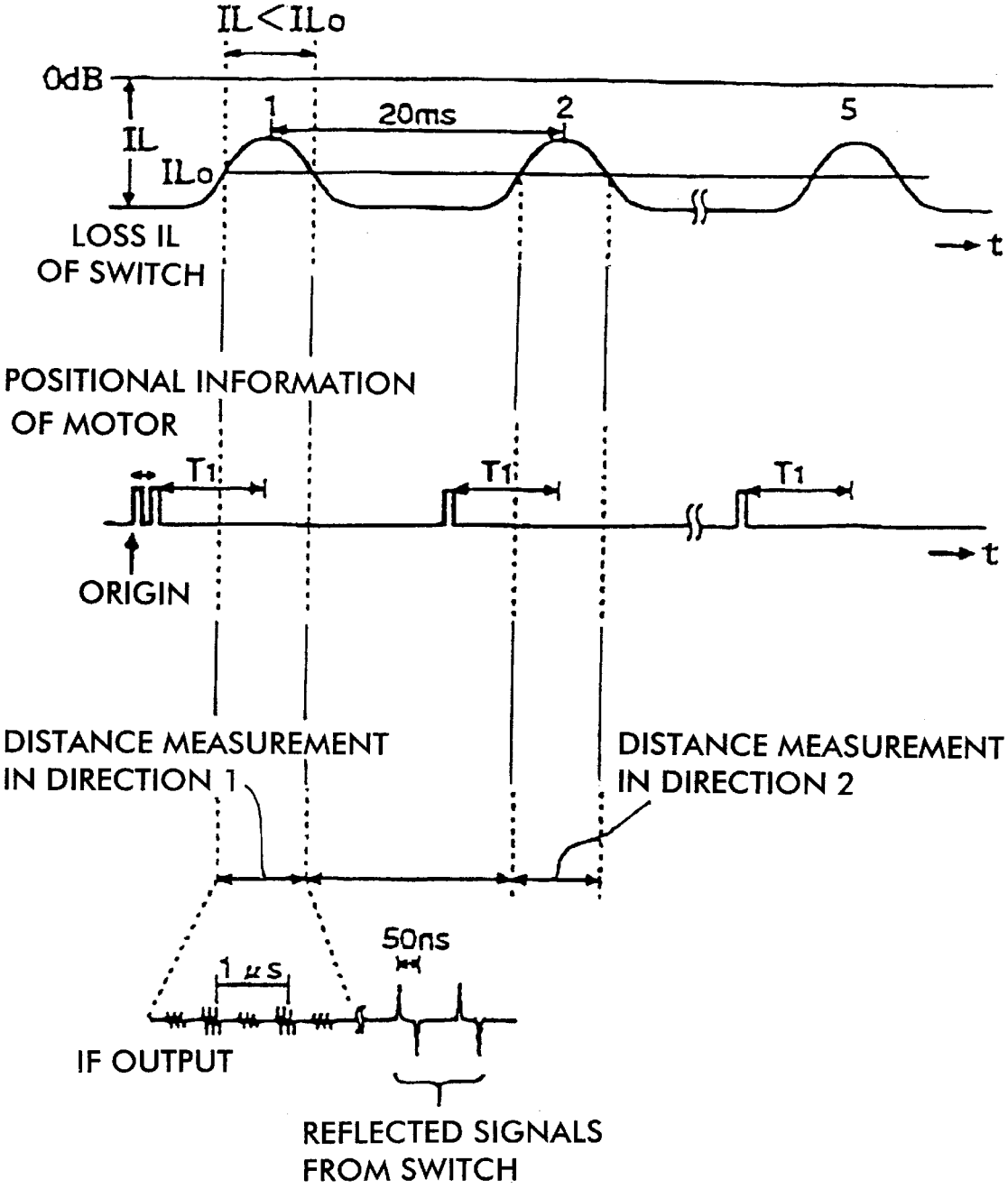
FIG. 25 is a graph indicating a detection timing obtained during the rotation of a rotary unit.

Since a rotating position of the above rotary unit may be detected by a rotary encoder, a driving motor is allowed to rotate at a speed (not necessarily a constant speed) not related to a driving pulse of VOC, and it is only necessary to process an output signal of IF signal in accordance with a rotating position of the rotary unit. FIG. 25 is used to indicate an example of timing for the above detection. Positional information of the rotary unit may be obtained by counting the output pulse of the rotary encoder. When a value representing such information is within a predetermined range, i.e., when an insertion loss IL caused by a dielectric line switch is less than a maximum value ILo of a loss of a switch (capable of signal detection), it is necessary only to transmit an FM pulse modulated signal modulated by a pulse signal having a pulse period of 50 ns and a cycle of 1 μs, and to sample an IF signal (an intermediate frequency signal obtained by mixing together a received signal and a RF signal) obtained by receiving a reflected wave. Although FIG. 25 is used to explain a modulation with the use of an FM pulse, a principle indicated in the figure also applies to an FM-CW method. In this way, while the rotary unit rotates, once mutually facing two dielectric strips become staggered from each other, a reflected signal will be generated. But, there will be no other problems since no sampling is performed during this period.

Figure 26A:
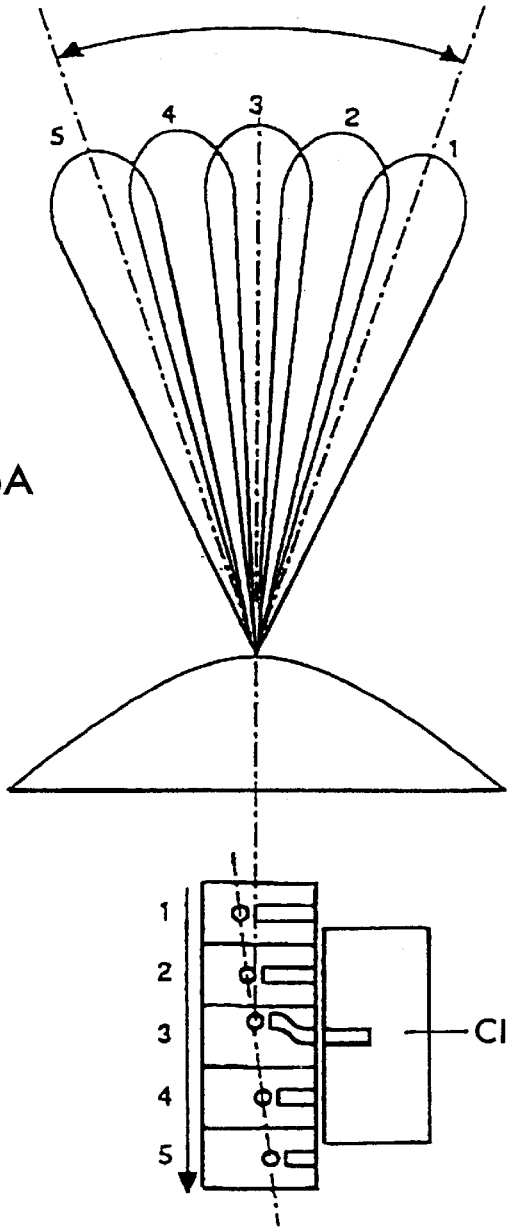
FIGS. 26A–26D are explanatory views schematically illustrating beam scanning areas formed by the rotation of a rotary unit.
Figure 26B:
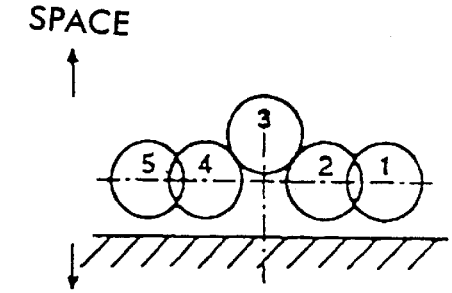
Figure 26C:
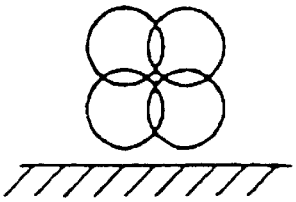
Figure 26D:
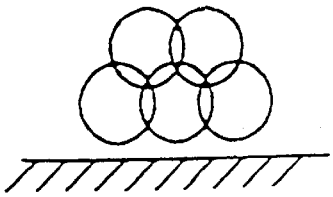

FIGS. 26A–26D are used to illustrate another example indicating a further structure of a rotary unit. In FIG. 20, it was illustrated that a plurality of primary radiators are provided on a center axis on each side face of a polygonal block, but it is also possible that a beam may be enabled to scan an elevation angle by disposing a primary radiator at a position deviated from a center axis. In an example shown in FIG. 26, a third primary radiator is provided in a position deviated from a corresponding center axis. In fact, FIG. 26B illustrates covered areas ahead of an antenna device, with respect to various shapes of discretely scanned beams, and it is understood from this drawing that a third beam is enabled to scan in an elevation angle direction. With the use of an effect shown in FIG. 26, a beam may be caused to scan not only in a left/right direction in the drawing, but also in an elevation angle direction. Further, it is also possible to effect a scanning in both a left/right direction and an elevation angle direction, in a manner as shown in FIGS. 26C and 26D. Moreover, it is not necessary to successively deviate the positions of the primary radiators on all the side surfaces of the rotary unit. Instead, it is necessary only to optionally decide the positions of the primary radiators on all the side surfaces of the rotary unit, such that scanning may be performed in an order of 1→3→5→2→4→1 or in an order of 1→4→2→5→3→1, as shown in FIG. 26B.

Figure 27A:
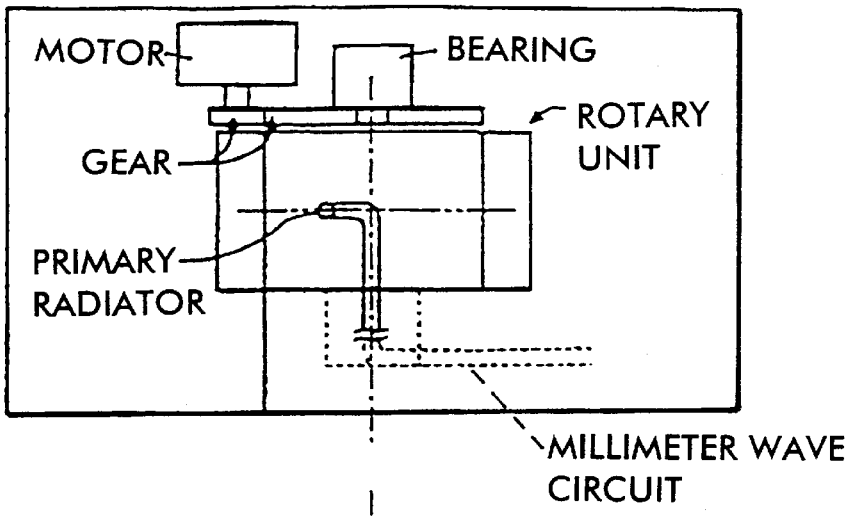
FIGS. 27A–27C are explanatory views illustrating the structure of a radar module.
Figure 27B:
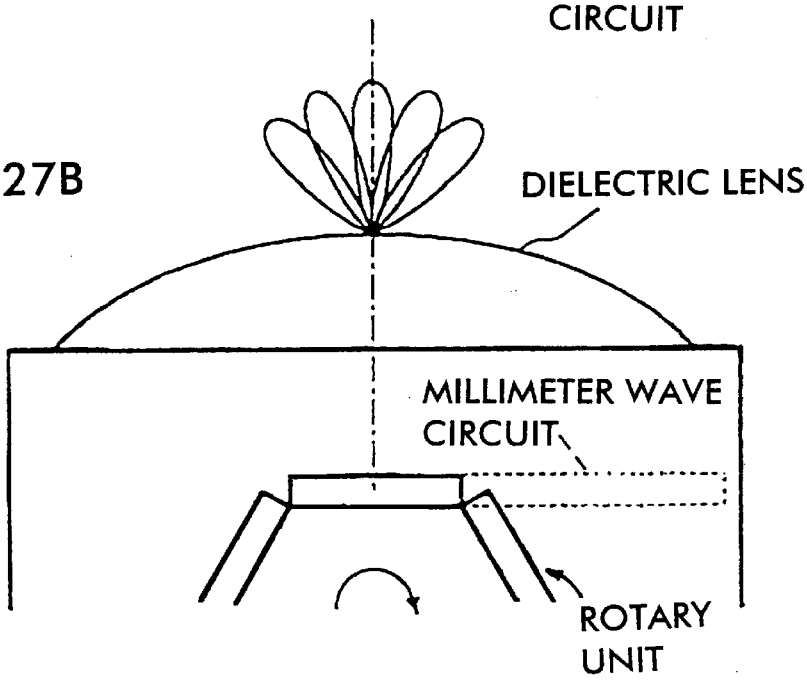
Figure 27C:
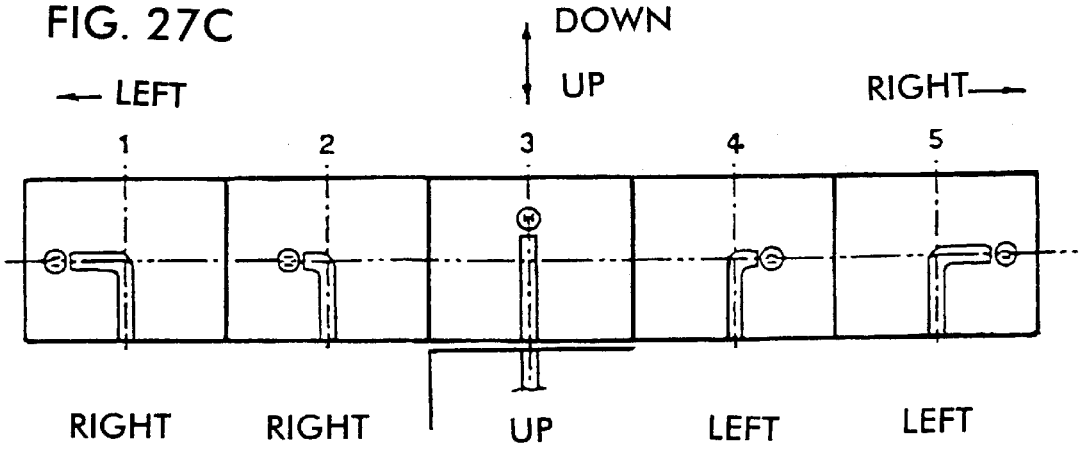

FIGS. 27A, 27B, 27C are used to illustrate the structure of a radar module which has been fabricated to be able to prevent an undesired scanning in an elevation angle direction (possibly caused when the rotary unit is rotating). In more detail, FIG. 27A is a top plane view showing the radar module with its dielectric lens taken away for the sake of an easy explanation, FIG. 27B is a side elevation viewed in a direction of a rotating axis of the rotary unit, FIG. 26C is a developed view showing all the side surfaces of the rotary unit. In this way, by deviating the positions of the primary radiators in a direction orthogonal to the rotating axis of the rotary unit, when the dielectric lines are rotated in a mutually connected condition, the beams will be caused to scan in a rotating direction of the rotary unit, thereby preventing undesired scanning toward an elevation angle direction. Nevertheless, in this example, since the position of a third primary radiator is deviated in the vertical direction in the drawing, this radar is a three dimensional radar similar to the example shown in FIG. 26.

Figure 28A:
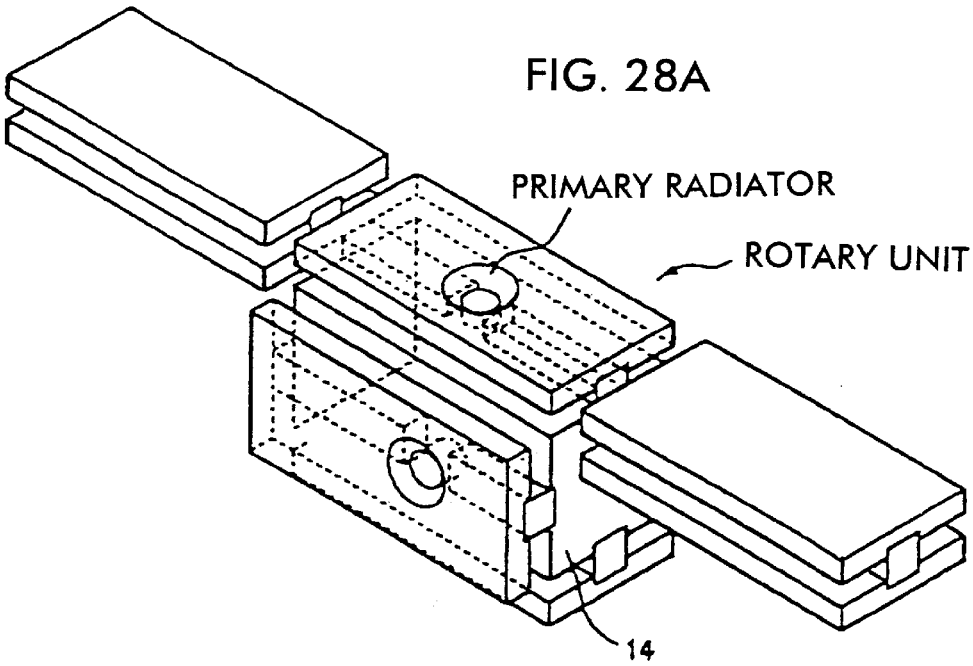
FIG. 28A is a perspective view indicating a radar module.
Figure 28B:
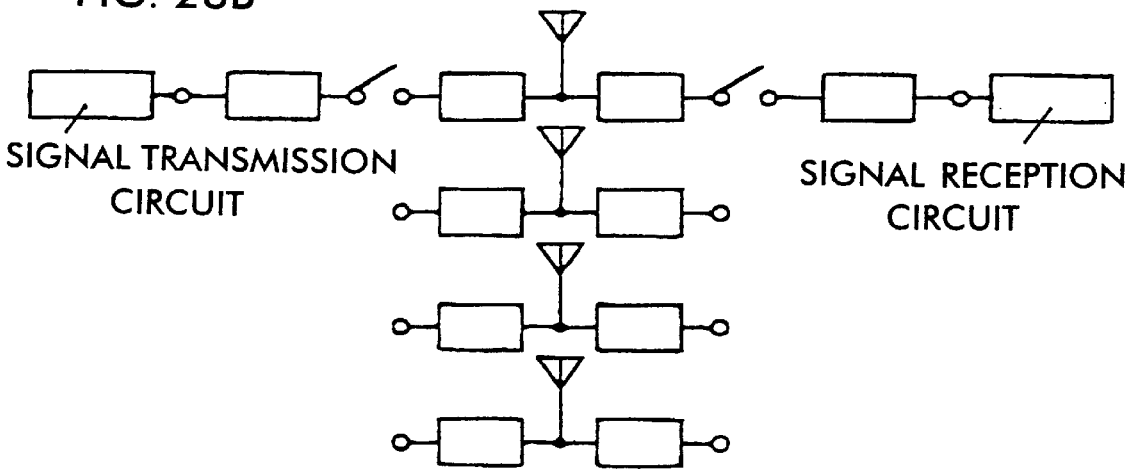
FIG. 28B is a block diagram indicating an equivalent circuit for the radar module of FIG. 28A.

FIGS. 28A and 28B are used to illustrate an example where transmission signal and reception signal may be distributed without a necessity of using a circulator. The basic constitutions of the example shown in FIGS. 28A and 28B have already been disclosed in Japanese Patent Application No. 8-280681. As shown in FIG. 28A, on four side surfaces of the metal block 14 there are provided dielectric lines and primary radiators. By rotating the rotary unit, the primary radiators will be alternatively moved to a dielectric line in connection with a signal transmitting circuit and to another dielectric line in connection with a signal receiving circuit. FIG. 28B is a block diagram showing an equivalent circuit for the device shown in FIG. 28A.

Figure 29:
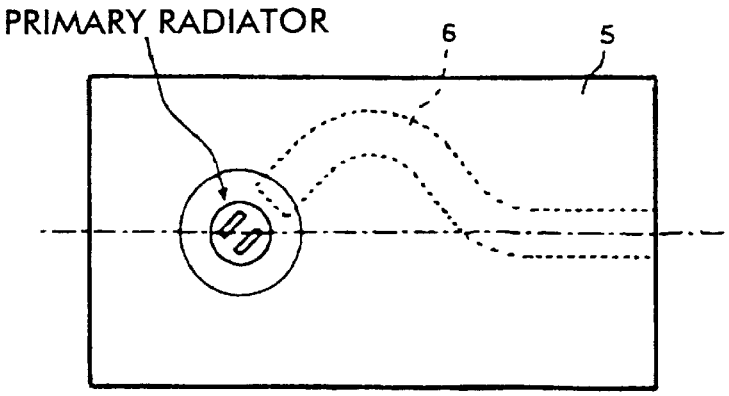
FIG. 29 is a plane view indicating a rotary unit in a condition of 45 degree polarization.

Although it has been described in the above examples that the plane of polarization is arranged in a horizontal direction, it is also possible that such plane of polarization may be arranged in an 45 degree direction as shown in FIG. 29. As shown in FIG. 29, one end of dielectric strip may be made to approach (at an angle of 45 degree) to a dielectric resonator which constitutes a primary radiator. In this arrangement, the slits of the slit plate may also be arranged in an inclined manner at an angle of 45 degrees.

FIGS. 30A, 30B, 30C are used to illustrate an example where one of four primary radiators is arranged in a direction that is different from the other three. FIG. 30A is a perspective view indicating an important portion of a radar module, in which a dielectric line 12 (not carrying a primary radiator) is provided on one side surface of a rotary unit. Under a condition as shown in FIG. 30A, an electromagnetic wave may be propagated through the dielectric lines 11, 12 and 13. Referring again to FIG. 30A, on one end of the dielectric line 13, a front end of its dielectric strip is formed into a rod antenna 43 which is directed in the same direction as the front end of the dielectric line 13. On each of the other three side surfaces, there is provided a primary radiator. If a primary radiator is provided on the upper side surface, it will be directed toward the upper side. FIG. 30B is an explanatory view schematically illustrating the structure of an entire radar module and indicating a position for the radar to be attached on to an automobile vehicle. As shown in FIG. 30B, either a radome or a dielectric lens is provided to cover up the front end of the rod antenna 43. FIG. 30C is a block diagram indicating an equivalent circuit for a device of FIG. 30A. In this way, the three primary radiators are used to detect a situation ahead of this vehicle, while at the same the rod antenna is used to detect a situation on the right side of the vehicle.

Figure 31A:
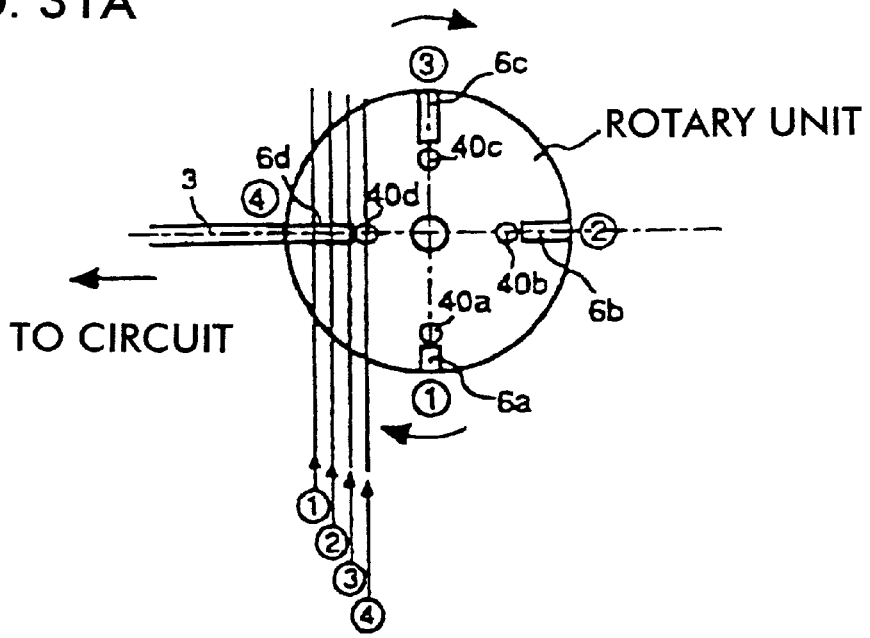
FIGS. 31A and 31B are explanatory views indicating the structure of a radar module.
Figure 31B:
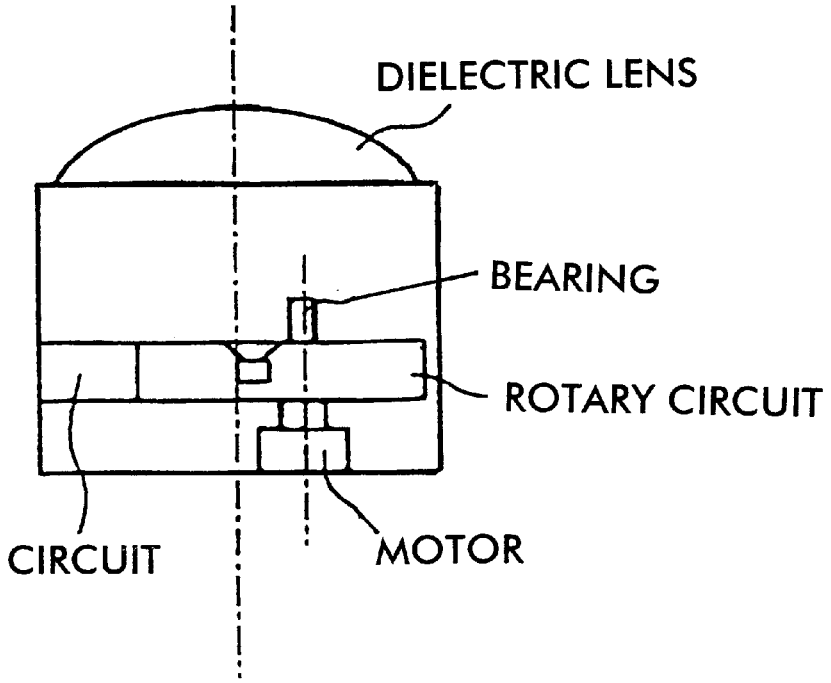

FIGS. 31A and 31B are used to illustrate an example where the primary radiators are turnably movable along the surface of a conductive plate. FIG. 31A is a top plane view indicating a radar module with its upper conductive plate taken away for the sake of an easy explanation. FIG. 31B is used to indicate a positional relationship between the dielectric lens and a rotary section. The rotary section includes four dielectric strips 6*a*, 6*b*, 6*c*, 6*d* and four dielectric resonators 40*a*, 40*b*, 40*c*, 40*d*, all of which are disposed between the upper conductive plate and lower conductive plate. Under an arrangement shown in FIG. 31A, dielectric strips 3 and 6 are caused to face each other, the dielectric resonator 40*d* serves as a primary radiator. In this manner, by rotating the rotary section, positions on a plane on which focal point (of the dielectric lens) is located, will be successively changed in an order of ①–④.

FIGS. 32A, 32B, 32C are used to illustrate a radar module in which the primary radiators are not moved but selectively used. In the example shown in FIGS. 32A, 32B, 32C, an oscillator, an isolator, a mixer, a coupler, and a circulator are all the same as those used in the above prior arts. Here, there are provided dielectric resonators 40*a*, 40*b* and 40*c* for use as primary radiators, and dielectric strips 7*a*, 7*b* and 7*c*, with the laters located adjacent to the formers. The rotary section comprises upper and lower conductive plates, three dielectric strips interposed between the conductive plates, and further includes terminals. Under a condition as shown in FIG. 32B, one port of the circulator is connected with the dielectric strip 7*c*, rendering the dielectric resonator 40*c* to be effective. On the other hand, under a condition as shown in FIG. 32C, one port of the circulator is connected with the dielectric strip 7*b*, rendering the dielectric resonator 40*b* to be effective. In this way, through the rotation of the rotary section, the position of a primary radiator (to be used) may be moved into a plane where the focal point of the dielectric lens is located.

Figure 33A:
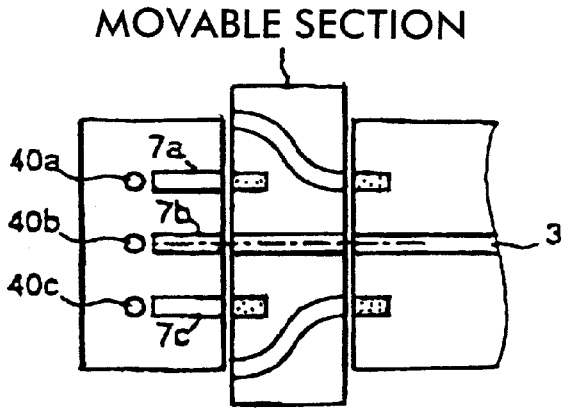
FIGS. 33A–33C are explanatory views indicating another example of a change-over circuit of a primary radiator.
Figure 33B:
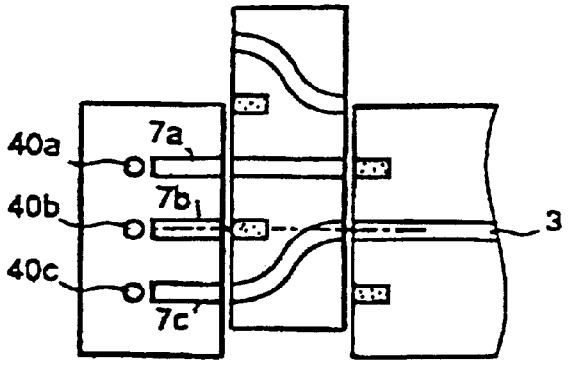
Figure 33C:
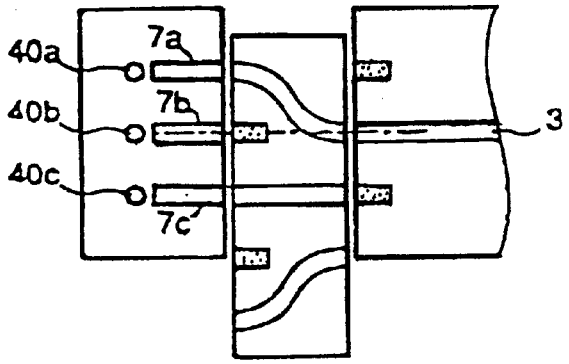

Although it has been described in the above examples that the positions of the primary radiators may be changed over with a rotating movement, it is also possible that such change-over may be achieved by a linear movement, as shown by FIGS. 33A, 33B and 33C, in each of which the upper conductive plate has been taken away for the sake of easy explanation. In fact, a moving section is provided with three dielectric strips. When in a condition shown in FIG. 33A, dielectric strips 3 and 7*b* are connected with each other through a dielectric strip on the center of the moving section, and a dielectric resonator 40*b* is used as a primary radiator. When in a condition shown in FIG. 33B, dielectric strips 3 and 7*c* are connected with each other through a dielectric strip on the lower side of the moving section, and a dielectric resonator 40*c* is used as a primary radiator. Further, when in a condition shown in FIG. 33C, dielectric strips 3 and 7*a* are connected with each other through a dielectric strip on the upper side of the moving section, and a dielectric resonator 40*a* is used as a primary radiator.

Figure 34A:
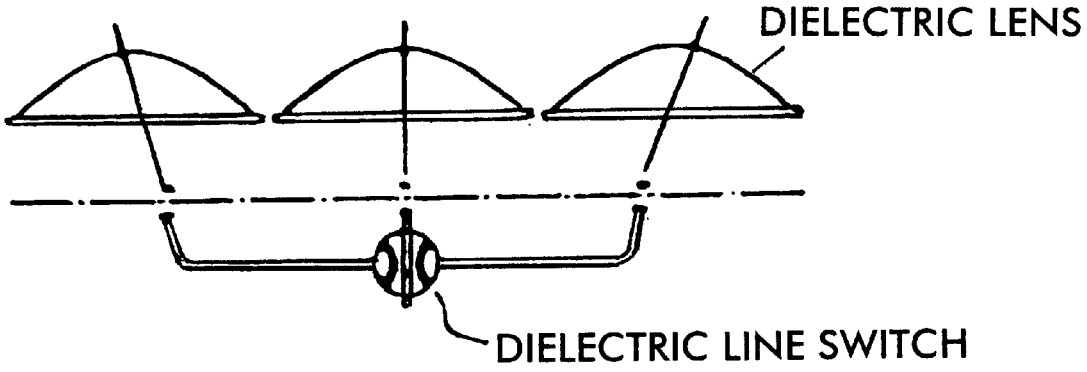
FIGS. 34A and 34B are explanatory views indicating an antenna device made according to the present invention.
Figure 34B:
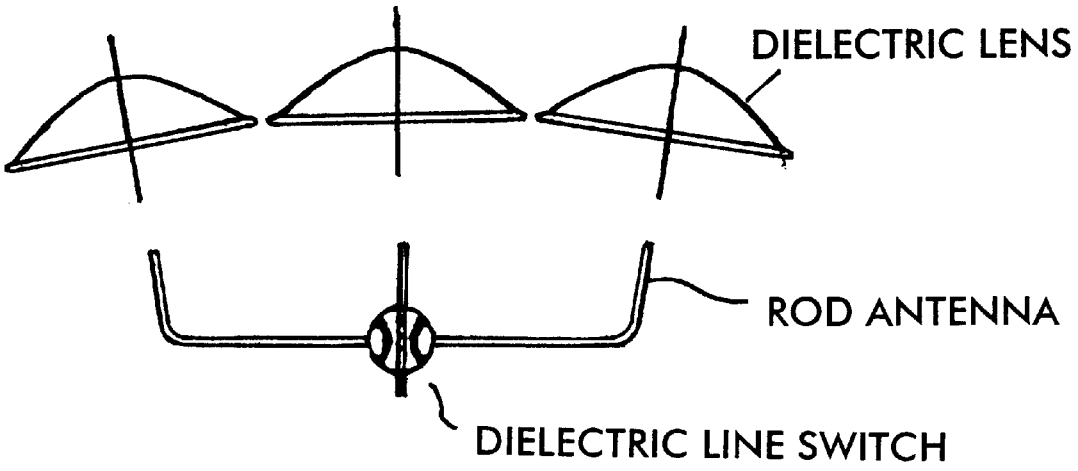

Although it has been described in the above examples that in most cases only one dielectric lens is employed and that the positions of primary radiators may be moved, it is also possible that a plurality of dielectric lenses may be arranged, and beam directions may be changed over by changing over the dielectric lenses with respect to the primary radiators. The upper half of FIG. 34A is a cross sectional view, and the lower half of FIG. 34A is a plane view. In an example shown in FIG. 34A, with respect to dielectric resonators for use as primary radiators, the dielectric strips may be changed over by virtue of the dielectric line switch. In an example shown in FIG. 34B, a dielectric line switch is used to change over a dielectric strip in which a front end is used to serve a rod antenna for use as a primary radiator.

Figure 35:
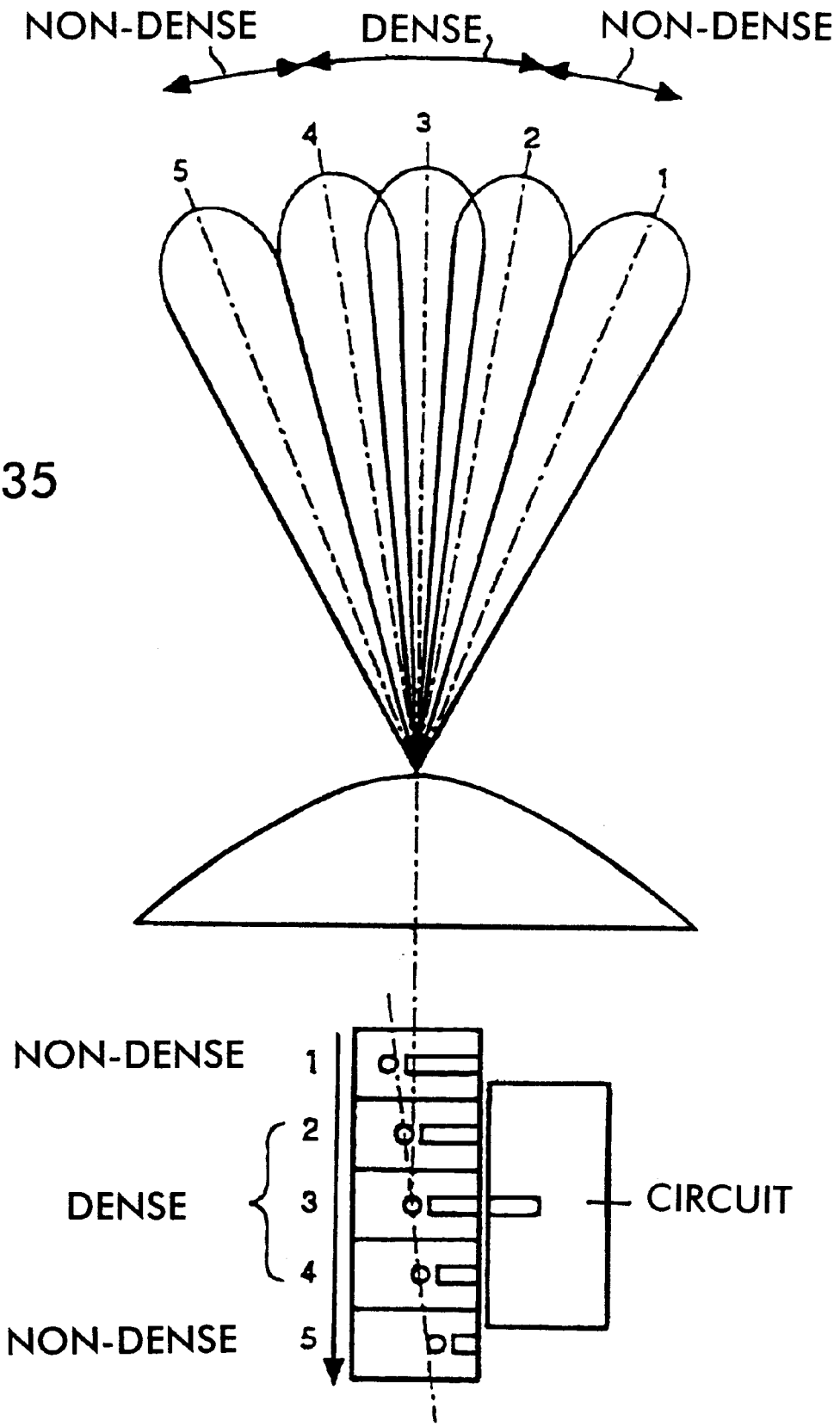
FIG. 35 is an explanatory view indicating a positional relationship between a dielectric lens and a primary radiator in an antenna device.

In an example shown in FIG. 20, it has been described that beam is caused to scan for each predetermined angular interval. However, this angular interval is not necessarily to be constant. In fact, it is possible that a detection may be effected with a high density in a range of an angle which is highly important. On the other hand, a detection may be completed with a low density in a range of an angle which is not so important, as shown in FIG. 35. In particular, FIG. 35 is used to illustrate a positional relationship between a dielectric lens and a primary radiator. The example shown in FIG. 35 is similar to an example shown in FIG. 20, in that all the side surfaces of a rotary unit are developed and arranged in a single one plane. As shown in FIG. 35, a first and a fifth primary radiators are deviated from a second and a fourth primary radiators, and are provided in positions separated from adjacent primary radiators, so that an angular interval between the first and second beams and another angular interval between the fourth and fifth beams are made to be at a low density, whilst an angular interval from the second to fourth beams is made to be at a high density. Since a positional deviation (an off-set distance) of a primary radiator has nothing to do with the size or an interval between adjacent primary radiators, such off-set distance may be freely decided. For this reason, which range of beam scanning is to be made at a high density and which range of beam scanning is to be made at a low density, may all be decided freely and optionally.

Although it has been described in the above examples that an antenna may be used in signal transmission and signal reception, it is also possible that an antenna for signal transmission and another antenna for signal reception are provided respectively.

As has been understood from the above description, with the use of the present invention, it is allowed to obtain at least the following effects.

Firstly, a mutually facing state of the two dielectric lines may be changed in a desired manner with the use of a mechanical control means, so that it is easy to perform a desired change-over operation in order that the propagation of an electro-magnetic wave may be continued or stopped, thereby permitting an easy operation for controlling the propagation of an electromagnetic wave.

Secondly, since dielectric lines may be repeatedly connected and disconnected in a desired manner only with the use of a motor to rotate a rotary unit mounting a plurality of dielectric lines, it is allowed to control the dielectric line switch by virtu of an electric means.

Thirdly, the relative movement of the two dielectric strips at the above dividing plane may be achieved by a linear movement of at least one of the two dielectric lines. Thus, dielectric lines may be repeatedly connected and disconnected in a desired manner only through a linear movement of a unit mounting a plurality of dielectric lines. As a result, it becomes possible that dielectric lines only need a reduced moving amount, and that a dielectric line device as a whole needs only fewer movable parts.

Fourthly, only by rotating the polygonal prismatic block member, a plurality of other dielectric lines may be selectively made directly facing certain one dielectric line. Thus, it is allowed to form a desired dielectric line switch which may enable a plurality of dielectric lines to be successively connected to the certain one dielectric line, with the use of a simplified structure.

Fifthly, since one of the above two dielectric lines may be rotated in a direction parallel to the conductive plates, it is possible to manufacture a dielectric line switch which has only a small thickness.

Sixthly, with the use of an antenna device of the present invention, the plurality of primary radiators may be selectively used, thereby rendering the antenna to perform an easy operation for the change-over of electromagnetic wave beams. Further, since a plurality of primary radiators may be attached to one rotary unit without a necessity of taking into account the size of the primary radiators and an interval distance between every two adjacent primary radiators, so that an antenna device employing such primary radiators is allowed to be made compact in size. Moreover, since an off-set position of a primary radiator may be optionally and freely decided, it is allowed to set the direction of an electromagnetic beam, freely and optionally in any desired manner. In addition, by increasing the number of side faces of a rotary unit formed into a polygonal prismatic block member, it is possible to easily increase scanning areas without a necessity of increasing an opening area of an antenna.

Finally, with the use of an antenna device of the present invention, it is possible to enable the beams of transmission wave and/or reception wave to scan in a desired manner, only by virtue of a mechanical control means without any necessity of moving the entire apparatus of a radar module.

What is claimed is:

1. A dielectric line switching for use in a dielectric line, said dielectric line including two conductive plates arranged in a manner such that they are substantially parallel to each other, and a dielectric strip interposed between the two conductive plates, said dielectric strip serving as a propagation path for an electro-magnetic wave to propagate therethrough, said dielectric line switch being characterized in that:

a plane generally perpendicular to a propagating direction of an electro-magnetic wave is defined as a dividing plane so as to divide the dielectric line into two dielectric lines;

the two dielectric lines are caused to move relative with respect to one another at the above dividing plane, in a manner such that two dielectric strips of the two dielectric lines may be, at the same dividing plane, made facing each other and not facing each other, alternatively;

further wherein the relative movement of the two dielectric strips at the above dividing plane is achieved by a rotating movement of at least one of the two dielectric lines; and further characterized in that when a direction perpendicular to the conductive plates is defined as a direction x, an electro-magnetic propagating direction is defined as a direction z, a direction perpendicular to both the direction x and the direction z is defined as a direction y, there is provided a polygonal prismatic block member having at least three side faces;

on the entire or part of each of the side faces there is provided one of the above dielectric lines which enables an axial direction of the polygonal prismatic block member to act as an electro-magnetic propagating direction z;

a central axis of the polygonal prismatic block member is used as a rotating center so as to rotate the polygonal prismatic block member, thereby rendering the one dielectric line to move generally in a direction y.

2. A dielectric line switching for use in a dielectric line, said dielectric line including two conductive plates arranged in a manner such that they are substantially parallel to each other, and a dielectric strip interposed between the two conductive plates, said dielectric strip serving as a propagation path for an electro-magnetic wave to propagate therethrough, said dielectric line switch being characterized in that:

a plane generally perpendicular to a propagating direction of an electro-magnetic wave is defined as a dividing plane so as to divide the dielectric line into two dielectric lines;

the two dielectric lines are caused to move relative with respect to one another at the above dividing plane, in a manner such that two dielectric strips of the two dielectric lines may be, at the same dividing plane, made facing each other and not facing each other, alternatively;

further wherein the relative movement of the two dielectric strips at the above dividing plane is achieved by a rotating movement of at least one of the two dielectric lines; and further characterized in that when a direction perpendicular to the conductive plates is defined as a direction x, an electromagnetic propagating direction is defined as a direction z, a direction perpendicular to both the direction x and the direction z is defined as a direction y, one of the above two dielectric lines may by rotated in a direction parallel to the conductive plates, thereby enabling the one dielectric line to move substantially in a direction y.

3. A dielectric line switching for use in a dielectric line, said dielectric line including two conductive plates arranged in a manner such that they are substantially parallel to each other, and a dielectric strip interposed between the two conductive plates, said dielectric strip serving as a propagation path for an electro-magnetic wave to propagate therethrough, said dielectric line switch being characterized in that:

a plane generally perpendicular to a propagating direction of an electro-magnetic wave is defined as a dividing plane so as to divide the dielectric line into two dielectric lines;

the two dielectric lines are caused to move relative with respect to one another at the above dividing plane, in a manner such that two dielectric strips of the two dielectric lines may be, at the same dividing plane, made facing each other and not facing each other, alternatively;

further wherein the relative movement of the two dielectric strips at the above dividing plane is achieved by a rotating movement of at least one of the two dielectric lines; and further characterized in that when a direction perpendicular to the conductive plates is defined as a direction x, an electro-magnetic propagating direction is defined as a direction z, a direction perpendicular to both the direction x and the direction z is defined as a direction y, one of the above two dielectric lines may be rotated with the direction y serving as a rotating axis, thereby enabling the one dielectric line to move substantially in a direction x.

4. A dielectric line switching for use in a dielectric line, said dielectric line including two conductive plates arranged in a manner such that they are substantially parallel to each other, and a dielectric strip interposed between the two conductive plates, said dielectric strip serving as a propagation path for an electro-magnetic wave to propagate therethrough, said dielectric line switch being characterized in that:

a plane generally perpendicular to a propagating direction of an electro-magnetic wave is defined as a dividing plane so as to divide the dielectric line into two dielectric lines;

the two dielectric lines are caused to move relative with respect to one another at the above dividing plane, in a manner such that two dielectric strips of the two dielectric lines may be, at the same dividing plane, made facing each other and not facing each other, alternatively;

further wherein the relative movement of the two dielectric strips at the above dividing plane is achieved by a rotating movement of at least one of the two dielectric lines; and further characterized in that when a direction perpendicular to the conductive plates is defined as a direction x, an electro-magnetic propagating direction is defined as a direction z, a direction perpendicular to both the direction x and the direction z is defined as a direction y, one of the above two dielectric lines may be rotated with the direction z serving as a rotating axis, thereby enabling the one dielectric line to move substantially in a direction x.

5. An antenna device comprising a plurality of dielectric lines, characterized in that each of the dielectric lines is provided with a primary radiator on an end or middle portion thereof, dielectric line switches according to claims 1, 2, 3 or 4 are provided between the plurality of dielectric lines and other dielectric lines, so as to effect an input/output change-over between said other dielectric lines and said primary radiators.

6. An antenna device according to claim 5, wherein a plurality of primary radiators are disposed at positions close to a focal point of a dielectric lens, a change-over operation may be performed among the primary radiators to deflect beams of transmission wave and/or reception wave.

* * * * *